US011406860B2

(12) United States Patent
Sims, Jr. et al.

(10) Patent No.: US 11,406,860 B2
(45) Date of Patent: Aug. 9, 2022

(54) ISOMETRIC, DYNAMIC ISOTONIC CONCENTRIC AND DYNAMIC ISOTONIC ECCENTRIC MOTORIZED GUIDANCE EXERCISE APPARATUS

(71) Applicants: Dewey M Sims, Jr., Royal Oak, MI (US); Dewey M Sims, III, Berkley, MI (US)

(72) Inventors: Dewey M Sims, Jr., Royal Oak, MI (US); Dewey M Sims, III, Berkley, MI (US)

(73) Assignee: McKinley Sims Holdings LLC, Berkley, MI (US)

( * ) Notice: Subject to any disclaimer, the term of this patent is extended or adjusted under 35 U.S.C. 154(b) by 27 days.

(21) Appl. No.: 16/865,314

(22) Filed: May 2, 2020

(65) Prior Publication Data

US 2021/0339067 A1 Nov. 4, 2021

(51) Int. Cl.
*A63B 21/002* (2006.01)
*A63B 21/062* (2006.01)
(Continued)

(52) U.S. Cl.
CPC ..... *A63B 21/0023* (2013.01); *A63B 21/0058* (2013.01); *A63B 21/0083* (2013.01); *A63B 21/023* (2013.01); *A63B 21/0557* (2013.01); *A63B 21/0628* (2015.10); *A63B 21/072* (2013.01); *A63B 21/225* (2013.01); *A63B 21/4007* (2015.10); *A63B 21/4013* (2015.10); *A63B 21/4034* (2015.10); *A63B 21/4049* (2015.10); *A63B 24/0087* (2013.01);
(Continued)

(58) Field of Classification Search
CPC ..... A63B 21/0023; A63B 21/0058; A63B 21/0628; A63B 21/154; A63B 21/225; A63B 21/4013; A63B 21/4034; A63B 21/4049; A63B 24/0087; A63B 71/0619; A63B 2071/0655
See application file for complete search history.

(56) References Cited

U.S. PATENT DOCUMENTS 2,784,591 A 3/1957 Shoor
6,551,219 B1 4/2003 Brown
(Continued)

*Primary Examiner* — Megan Anderson
(74) *Attorney, Agent, or Firm* — Mastrogiacomo PLLC; Patrick Mastrogiacomo, Jr.

(57) ABSTRACT

An isometric, dynamic isotonic concentric and dynamic isotonic eccentric motorized guidance exercise apparatus for human muscle development is provided. The exercise apparatus comprises a frame, an electric motor, the electric motor including an output shaft and secured to the frame, a drive guidance assembly, the drive guidance assembly secured to the frame and connected to the output shaft; at least one tactile feedback interface member, the at least one tactile feedback interface member secured to the drive guidance assembly; a weight plate, the weight plate secured to a limb of the human body, the limb positioned at the at least one tactile feedback interface member and wherein energizing the electric motor actuates the drive guidance assembly, the drive guidance assembly induces a motion in the at least one tactile feedback interface member, the limb engages the at least one tactile feedback interface member and the limb actuates the weight plate.

16 Claims, 26 Drawing Sheets

(51) Int. Cl.

| | |
|---|---|
| ***A63B 21/02*** | (2006.01) |
| ***A63B 21/005*** | (2006.01) |
| ***A63B 21/22*** | (2006.01) |
| ***A63B 22/06*** | (2006.01) |
| ***A63B 71/06*** | (2006.01) |
| ***A63B 21/072*** | (2006.01) |
| ***A63B 21/055*** | (2006.01) |
| ***A63B 21/00*** | (2006.01) |
| ***A63B 24/00*** | (2006.01) |
| ***A63B 21/008*** | (2006.01) |

(52) U.S. Cl.

CPC ..... *A63B 71/0619* (2013.01); *A63B 22/0605* (2013.01); *A63B 2022/0623* (2013.01); *A63B 2071/0655* (2013.01); *A63B 2208/0233* (2013.01); *A63B 2220/62* (2013.01)

(56) References Cited

U.S. PATENT DOCUMENTS

| | | | | |
|---|---|---|---|---|
| 7,998,042 | B2 * | 8/2011 | Bowser | A63B 21/4035 482/130 |
| 8,333,681 | B2 * | 12/2012 | Schmidt | A63B 21/0058 482/51 |
| 9,415,257 | B2 * | 8/2016 | Habing | A63B 22/0664 |
| 10,363,455 | B2 * | 7/2019 | Romero | A63B 22/0005 |
| 10,478,659 | B2 * | 11/2019 | O'Connor | A63B 21/159 |
| 2006/0019804 | A1 * | 1/2006 | Young | A63B 21/154 482/93 |
| 2013/0281271 | A1 * | 10/2013 | Nizam | A63B 23/03583 482/139 |
| 2021/0220704 | A1 * | 7/2021 | Claudio | A63B 21/0058 |

* cited by examiner

ISOMETRIC, DYNAMIC ISOTONIC CONCENTRIC AND DYNAMIC ISOTONIC ECCENTRIC MOTORIZED GUIDANCE EXERCISE APPARATUS

CROSS REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to an exercise apparatus and, more particularly, to an exercise apparatus that incorporates a motorized guidance mechanism that will improve fitness workouts and speed recovery and rehabilitation.

2. Background Art

There are many exercise apparatuses that are used to strengthen and tone muscles of the lower body and upper body extremities. Many individuals use these apparatuses to train muscles for a particular sporting event and to improve overall fitness. Still others use these machines to rehabilitate muscles that have grown weak and lost range of motion due to injury, lack of use or old age.

Cyclic ergometers are one such piece of exercise equipment that is used for high intensity sports training, developing overall fitness and rehabilitation of weak muscles. Typically, cyclic ergometers are operated solely under the power of the individual. Individuals rely on their own muscle strength and development to operate the cyclic ergometer. Further gains in muscle strength and development are realized when the individual is able to exercise the muscles past a point of fatigue. While there are those experienced with exercising muscles to fatigue to improve strength and stamina, there are many that cannot exercise their muscles to that point because their muscles may be too weak. Others may not know when their muscles are at a point of fatigue during an exercise session. In either case, individuals are likely not able to optimize their workout or rehabilitation session and, therefore, may delay desired results or slow recovery from injury or surgery. Furthermore, when individuals perform a specific exercise, they are only exercising their muscles in only one way. A typical exercise will either exercise muscles only as they lengthen or muscles only as they shorten. Typical exercises, such as cycling, walking, swimming and the like will not exercise muscles as they are both lengthening and shortening.

Various weight machines are other types of exercise equipment that may be used to develop muscles. These machines typically are equipped with adjustable weight plates that allow the user to choose a specific weight to lift. The weight machines may come in a variety of configurations to work the muscles of the chest, back, arms, legs and the like. Just as above with cyclic ergometers, individuals rely on their own muscle strength and endurance to use muscle groups to move the weights. Often individuals will jerk the weights when first beginning an exercise, the exertion phase, to overcome the initial weight and any friction in the exercise equipment. This added jerk or acceleration of the weight plates during the initial stages of the exercise to move the weight may not be expected by the individual and may lead to injuries in muscles, ligaments, tendons and bones. Similarly, individuals may allow the weights to fall rapidly during the lowing phase of the weights and stop suddenly when the weights reach the end of downward travel. This rapid deceleration force may also lead to injuries in muscles, ligaments, tendons and bones. Further, the individual often will not move the weights at a consistent speed or at a constant range of motion resulting in an inconsistent workout that may not yield the desired results and may lead to injuries in muscles, ligaments, tendons and bones.

As the global population ages, there is becoming an ever-increasing need for exercise equipment that will provide individuals the best results in the least amount of time and lower chances of injury. There is also a need for exercise equipment that is easy to operate and offers motorized guidance to individuals with muscles too weak to operate the exercise equipment. There is a further need for exercise equipment that is easy to operate and offers motorized guidance for those individuals that desire to speed muscle development and improve overall health while in a controlled manner, yet are unable to do so with traditional muscle development means such as weight lifting.

Therefore, a need exists for a motorized guidance exercise apparatus capable of enabling isometric, dynamic isotonic concentric and dynamic isotonic eccentric movement of muscles and joints within an individual to enable prolonged engagement in a particular exercise. The motor will continue to operate the equipment in a very controlled manner and enable the individual to maintain the exercise movement under a controlled consistent speed and motion to minimize accelerations and decelerations. Also, the motorized guidance exercise apparatus will exercise muscles of an individual as the muscles are both lengthening and as the muscles are shortening. Prior to each exercise, the apparatus allows individuals to vary speed, range of motion and amount of weight for core body exercises. Still further, the motorized guidance exercise apparatus may be capable of stopping the motion at any location for a period of time to produce isometric exercise as part of the dynamic isotonic concentric and dynamic isotonic eccentric exercise. This prolonged constant engagement in an exercise will push the muscles engaged in the exercise to the point of muscle fatigue and facilitate faster muscle development, a shorter muscle rehabilitation and overall recovery period while minimizing injury.

BRIEF SUMMARY OF THE INVENTION

An isometric, dynamic isotonic concentric and dynamic isotonic eccentric motorized guidance exercise apparatus for human muscle development is provided. The exercise apparatus comprising a frame, an electric motor, the electric motor including an output shaft and the electric motor secured to the frame, a drive guidance assembly, the drive guidance assembly secured to the frame and connected to the output shaft of the electric motor; at least one tactile feedback interface member, the at least one tactile feedback interface member secured to the drive guidance assembly; a resistance means, the resistance means secured to a part of the human body, for example, at a wrist, an ankle, a chest, the back or the head, the part of the human body, for example, the wrist, the ankle, the chest, the back or the head, positioned at the at least one tactile feedback interface member and wherein energizing the electric motor actuates the drive guidance assembly, the drive guidance assembly induces a motion in the at least one tactile feedback interface member, the part of the human body, for example, the wrist, the ankle the chest, the back or the head engages the at least one tactile feedback interface member and the part of the human body, for example, the wrist, the ankle, the chest, the back or the head actuates the resistance means.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
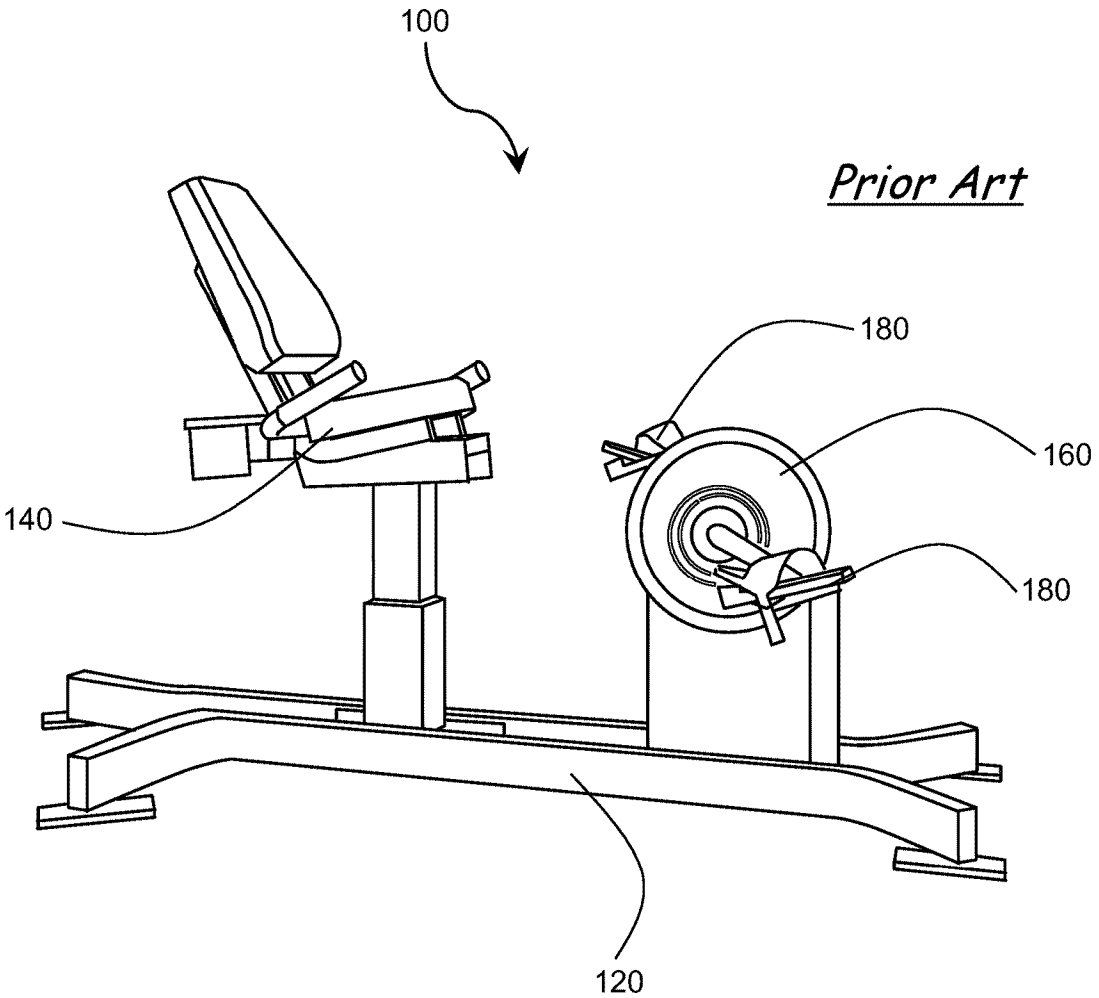
FIG. 1 is a side view of a typical prior art bicycle exercise apparatus.
Figure 2A:
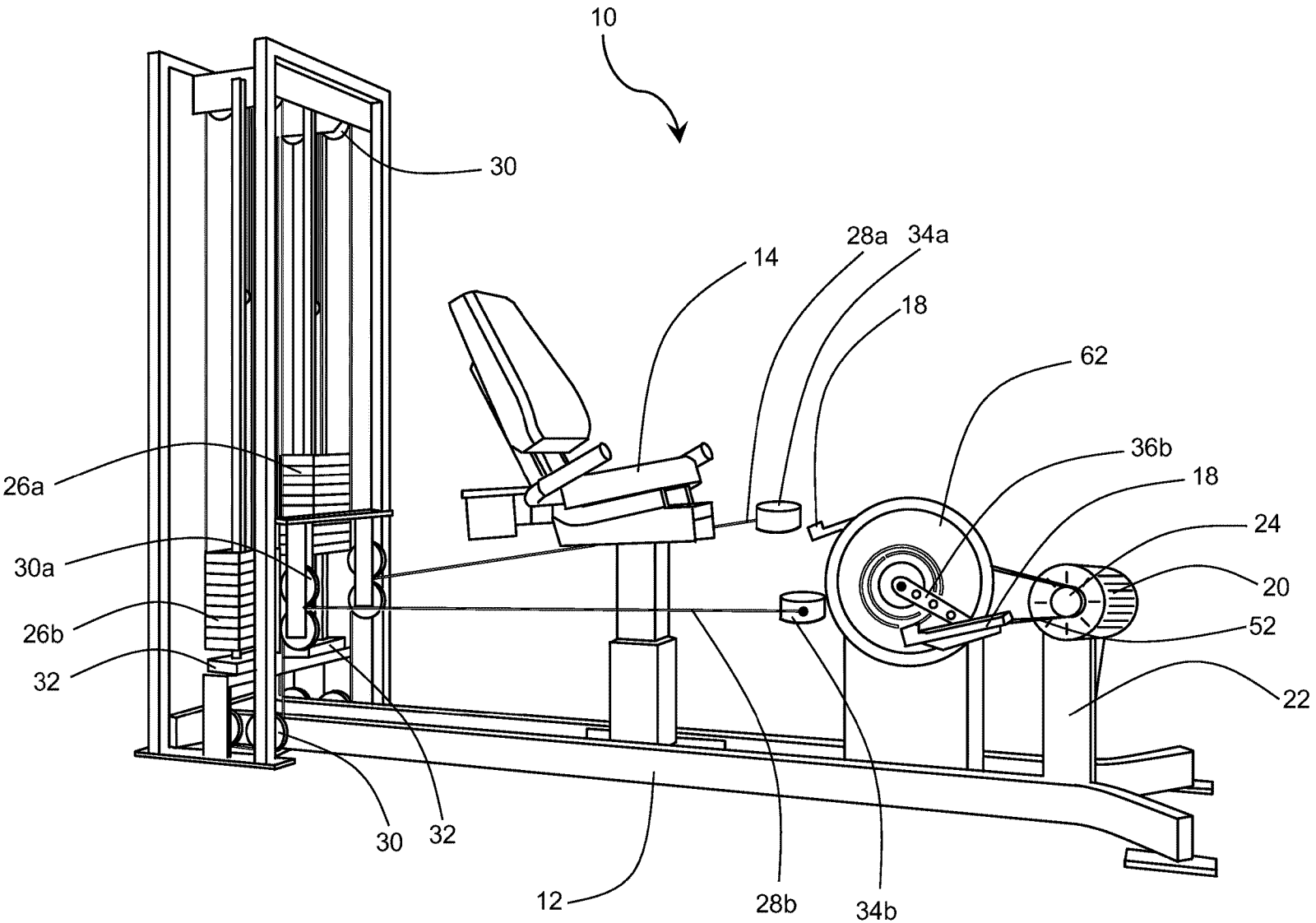
FIG. 2A is a perspective view of an isometric, dynamic isotonic concentric and dynamic isotonic eccentric motorized guidance exercise apparatus according to an embodiment of the present invention.
Figure 2B:
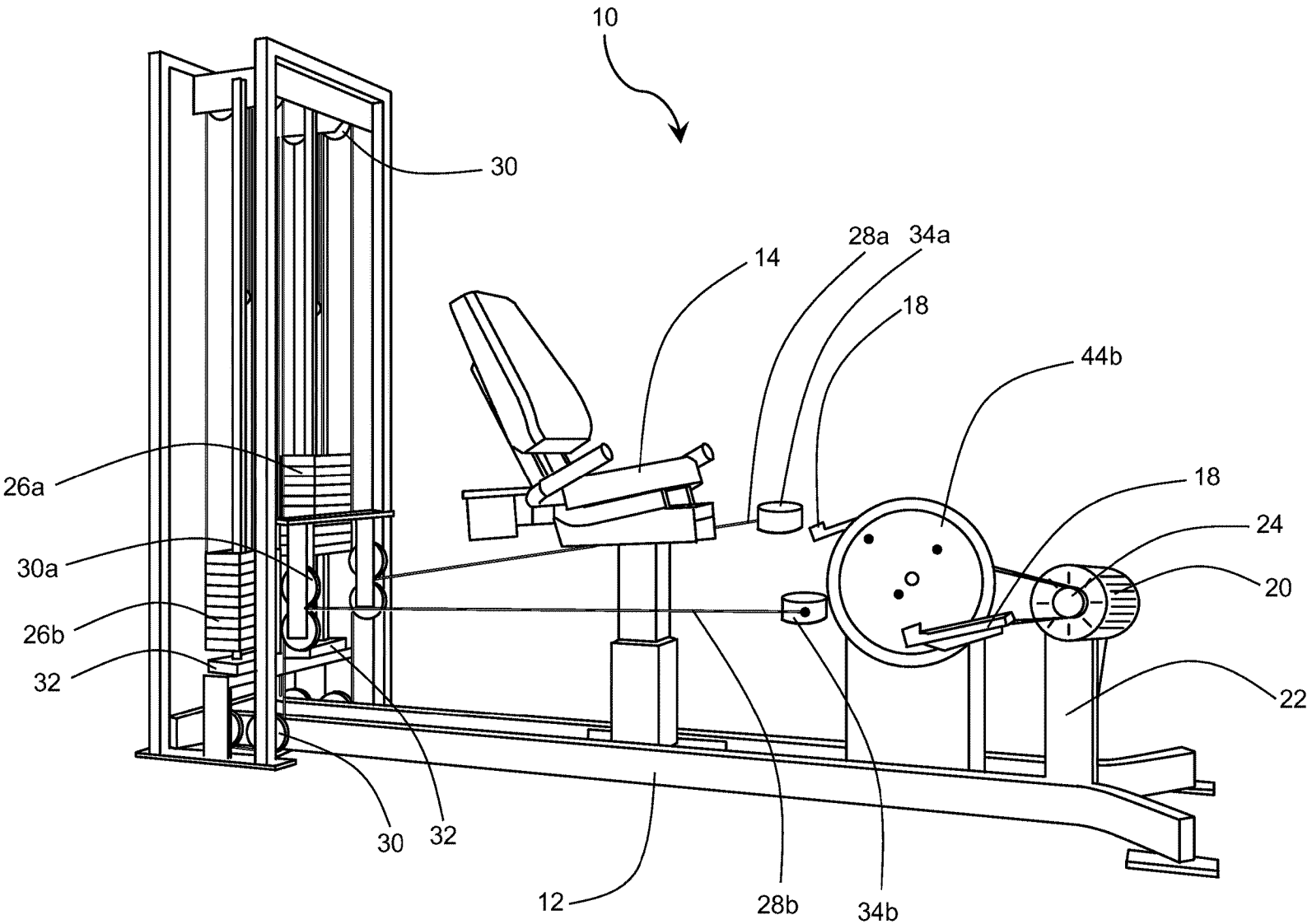
FIG. 2B is a perspective view of an isometric, dynamic isotonic concentric and dynamic isotonic eccentric motorized guidance exercise apparatus according to another embodiment of the present invention.
Figure 3A:
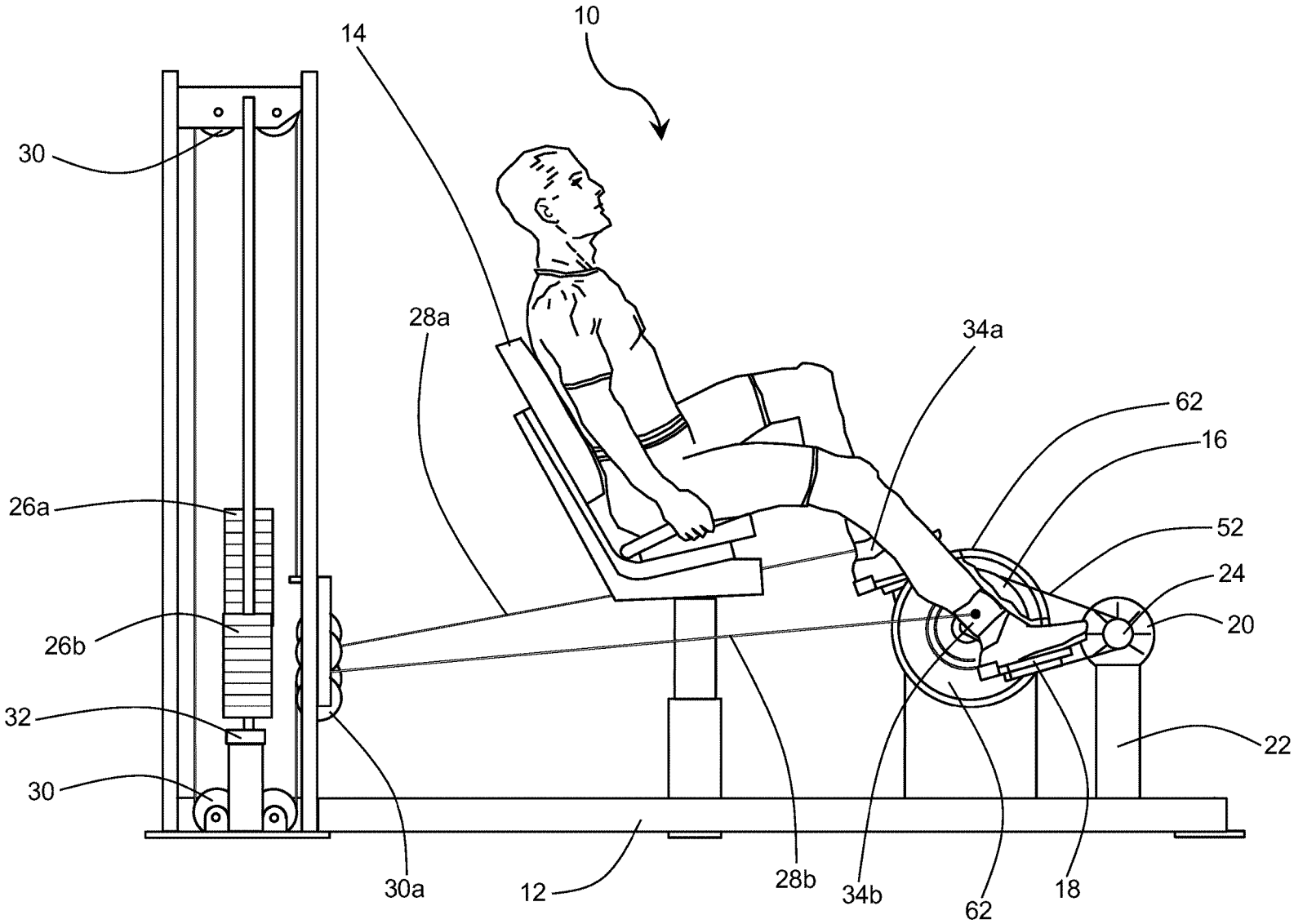
FIG. 3A is a side view of the motorized guidance exercise apparatus according to an embodiment of the present invention.
Figure 3B:
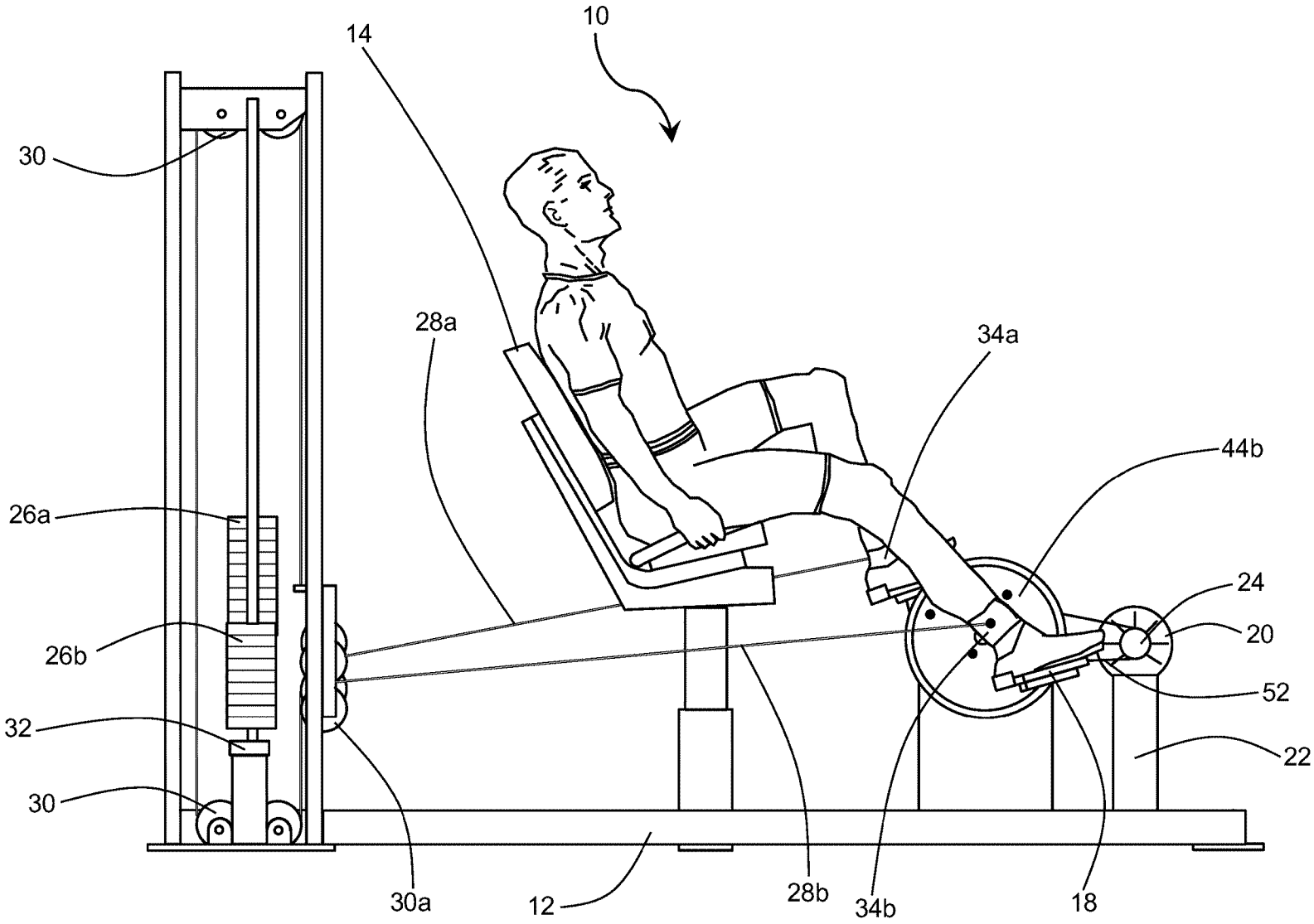
FIG. 3B is a side view of the motorized guidance exercise apparatus according to another embodiment of the present invention.
Figure 4:
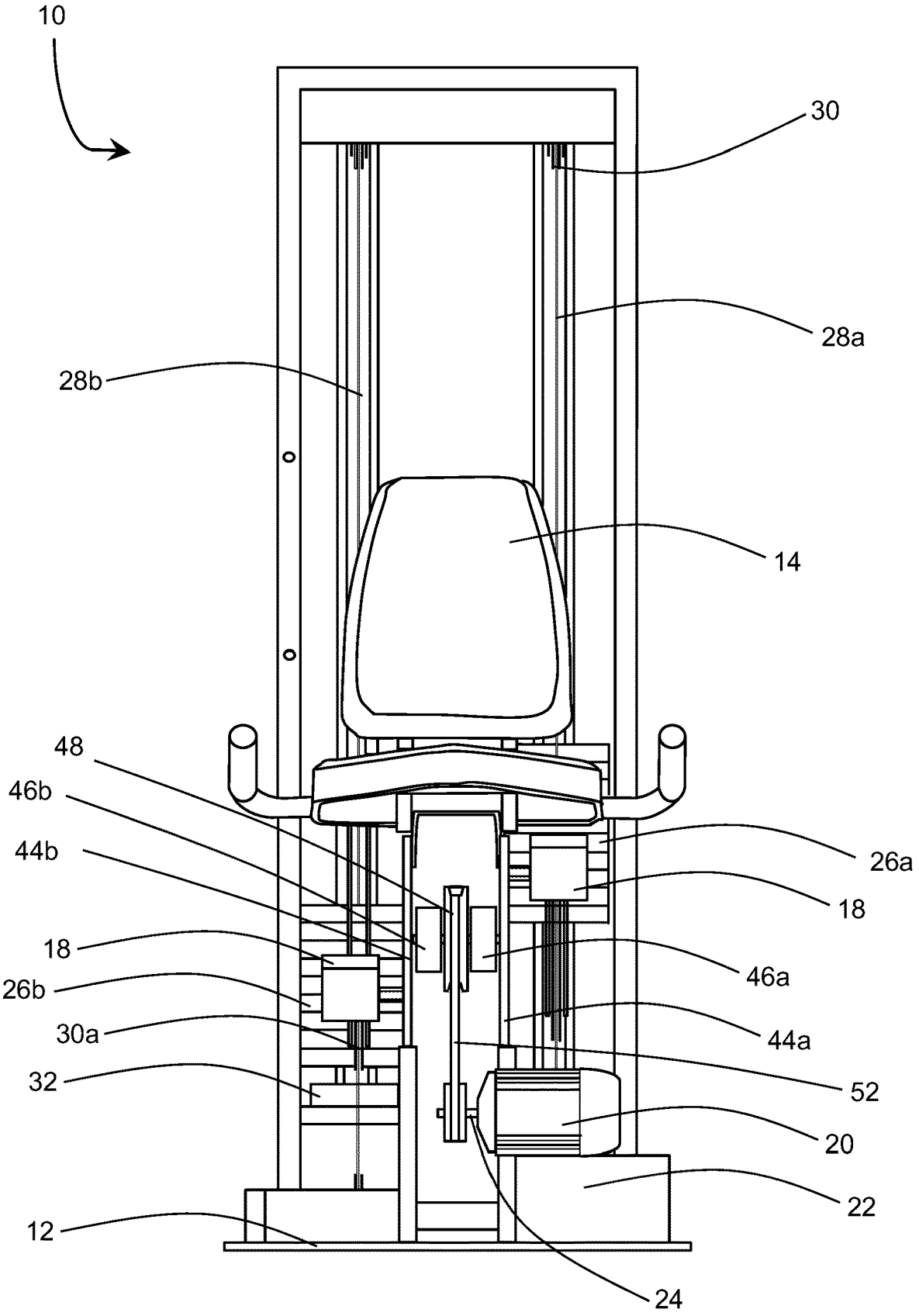
FIG. 4 is a front view of the motorized guidance exercise apparatus according to an embodiment of the present invention.
Figure 5:
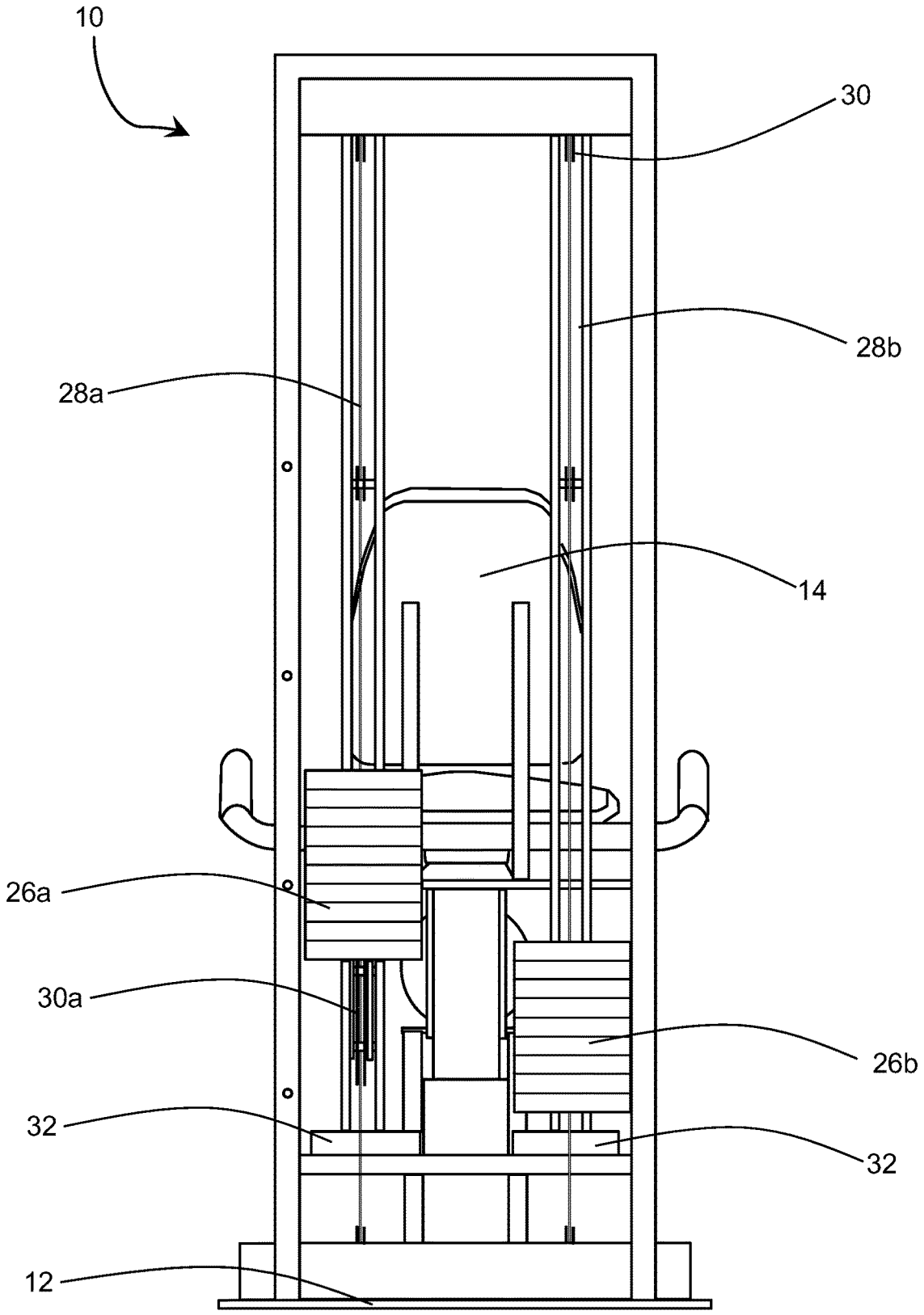
FIG. 5 is a rear view of the motorized guidance exercise apparatus according to an embodiment of the present invention.
Figure 6A:
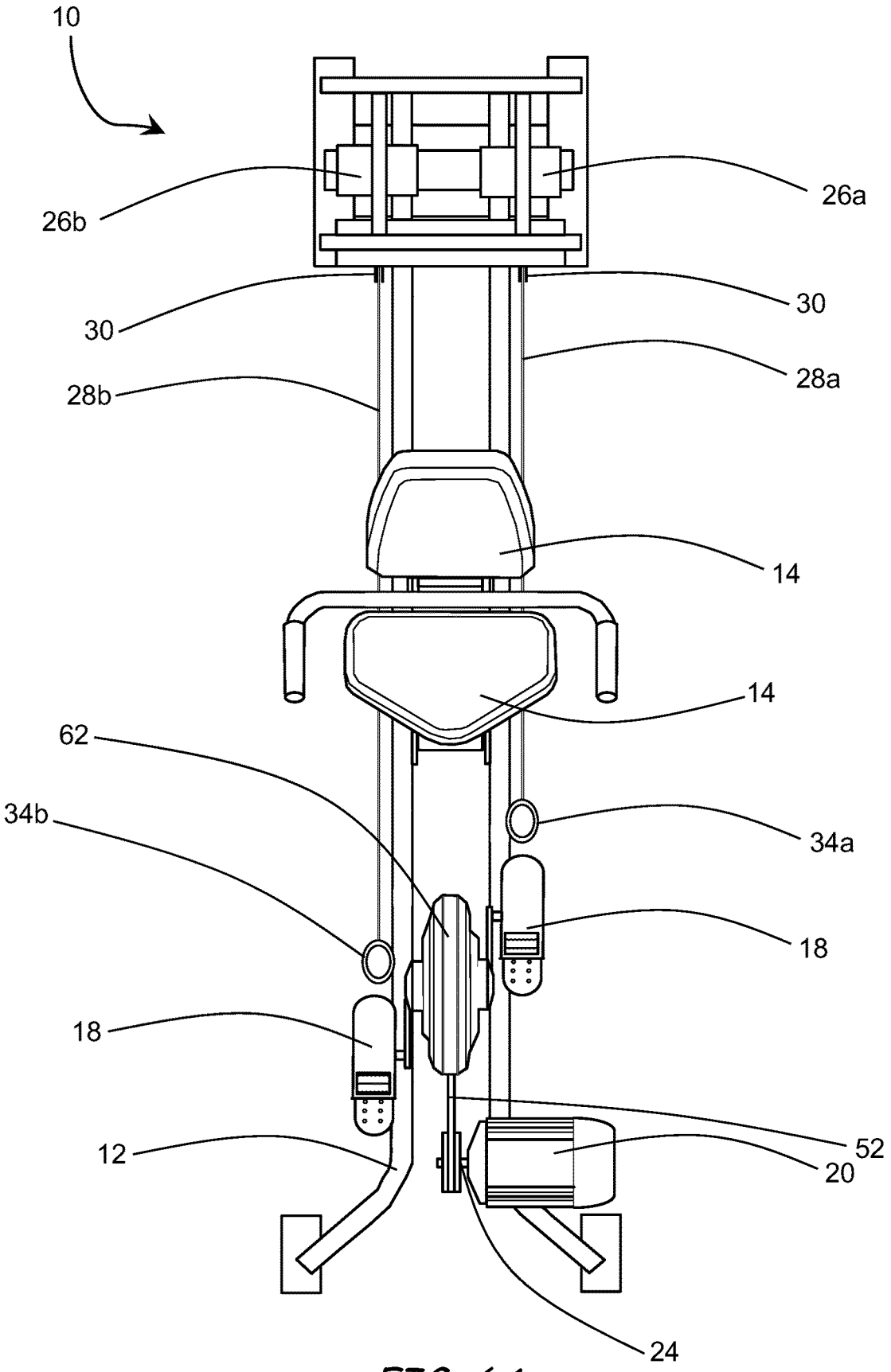
FIG. 6A is a top view of the motorized guidance exercise apparatus according to an embodiment of the present invention.
Figure 6B:
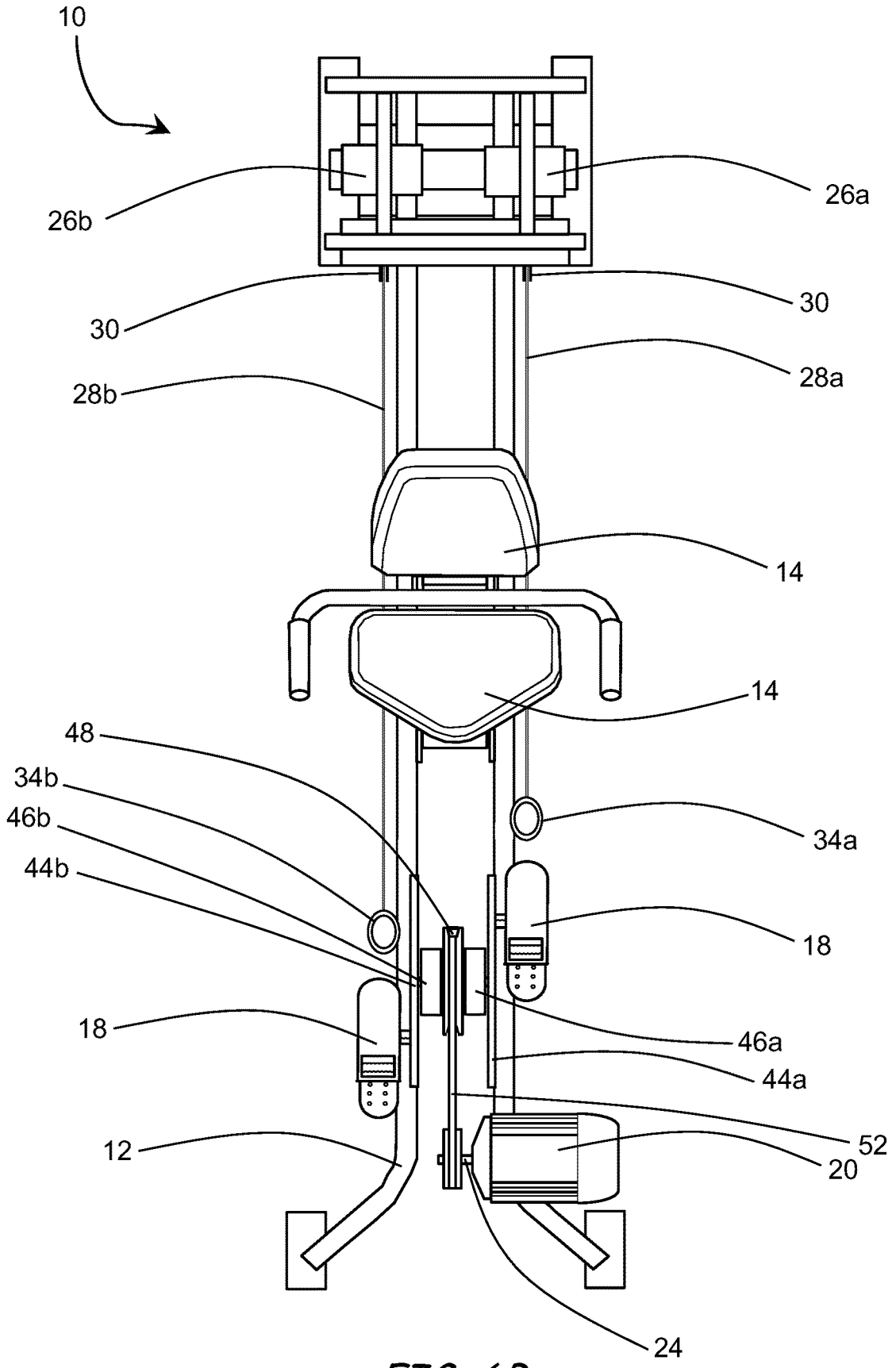
FIG. 6B is a top view of the motorized guidance exercise apparatus according to another embodiment of the present invention.

Referring now to the drawings, preferred illustrative embodiments of the present invention are shown in detail. Although the drawings represent embodiments of the present invention, the drawings are not necessarily to scale and certain features may be exaggerated to better illustrate and explain the present invention. Further, the embodiments set forth herein are not intended to be exhaustive or otherwise to limit or restrict the invention to the precise forms and configurations shown in the drawings and disclosed in the following detailed description.

An isometric, dynamic isotonic concentric and dynamic isotonic eccentric motorized guidance exercise apparatus 10 is presented below and illustrated in FIGS. 2A-9E. Exercise apparatus 10 may be used as an assistance means to effectively rehabilitate or exercise muscles that are, due to their physical limitation, are not able to operate a standard exercise apparatus under human muscle power alone. Apparatus 10 may also be used by individuals who desire to speed muscle development and improve overall health and fitness. Furthermore, apparatus 10 allows individuals with a limb that may have a disability (for example, one limb may not have a full range of motion and/or be weaker than the other limb) to use apparatus 10 when exercising both limbs by allowing the disabled limb to use lighter weight or a different stroke or range of motion. Still further, apparatus 10 will enable individuals to exercise various muscles of the human body through isometric exercises when the motorized guidance is stopped for a period of time at one or more predetermined locations.

In this particular embodiment of the present invention, apparatus 10 may be similar to, but has more control and more options than a typical stationary bicycle or cyclic ergometer as depicted in FIGS. 2A-7. Traditionally, an individual may use a stationary bicycle (see FIG. 1) or cyclic ergometer to exercise the lower extremities of the human body such as the muscles of the legs. Other cyclic ergometers may be used to exercise the upper extremities of the human body such as the muscles of the arms. Operating a bicycle or ergometer would also provide cardiovascular benefits to the heart and lungs and help to improve overall health and fitness. Exercise apparatus 10 may also be similar to, but has more control and more options than any exercise weight machine (see FIG. 8A-9E) as well to assist users with lifting weights to a point of fatigue to speed muscle development and/or rehabilitation. For example, apparatus 10 uses weights with more control and options than the typical weight machine that works muscles in the chest, arms, back, legs and the like.

A prior art exercise bicycle 100 illustrated in FIG. 1 includes a frame 120. Frame 120 supports a seat 140 and a drive assembly 160. Drive assembly 160 includes pedals 180 sized to accept the feet of an individual. An individual may operate the bicycle by taking a sitting position in seat 140 and placing feet on pedals 180 and rotating pedals about drive assembly 160. Another typical prior art exercise bicycle may use a motor connected to drive assembly 160 to drive pedals 180 through the rotational path at a fixed speed. In this particular exercise bicycle, the feet may be attached to pedals 180 and the motor drags the feet through the rotational path because the muscles of the legs are unable to move the pedals. In the traditional bicycle or ergometer, drive assembly 160 may include means to adjust the difficulty of rotating pedals 180 about drive assembly 160. A load or resistance may be provided by drive assembly 160 to increase or decrease the amount of work the individual applies to rotate drive assembly 160 by extending muscles to rotate pedals 180 about drive assembly 160 which work the muscles only when they are lengthening and not when shortening.

In a traditional stationary bicycle or cyclic ergometer, the load or resistance may be provided by the level of fiction between a belt and a flywheel positioned in drive assembly 160. The flywheel is driven by the rotation of pedals 180 while the belt engages the outer rim of the flywheel. One may increase the resistance of pedal rotation by increasing the amount of pressure or friction the belt applies to the flywheel thus making the flywheel more difficult to rotate relative to the belt and pedals 180 and requiring the individual to apply more force in terms of energy output by the individual to rotate pedals 180 and flywheel relative to the belt. This increased energy required of the muscles drives the muscles to fatigue and helps to improve muscle and cardiovascular health. Conversely, one may decrease the amount of pressure the belt applies to the flywheel to make the flywheel and pedals 180 easier to rotate relative to the belt, thereby requiring less force in terms of energy of the individual to rotate the pedals and flywheel relative to the belt. The lower resistance will require less energy of the muscles to move the pedals. Increasing and decreasing the amount of resistance is left completely to the individual operating the bicycle or ergometer and may likely result in not receiving optimal benefits of the exercise due to muscles being very weak to operate the apparatus or the individual not knowing that they have fully fatigued the muscles for optimal health benefits.

According to an embodiment of the present invention, a motor 20 may be added to the stationary bicycle or cyclic ergometer to enable motorized guidance exercise apparatus 10 illustrated in FIGS. 2A-7. Motor 20 is supported and secured to frame 12 at stanchion 22. Motor 20 is further secured to a drive guidance assembly by belt 52. In this embodiment of the present invention, the drive guidance assembly includes a cover 62 and a flywheel 16 (see FIGS. 3A and 10A-10C). Motor 20 may be any type of motor including but not limited to a typical induction motor, a direct drive motor, a linear motor, a servo motor, a stepper motor and the like that may be connected to a power supply such that when motor 20 is energized, a shaft 24 of motor 20 is rotated within motor 20. Shaft 24 may be connected to flywheel 16 through belt 52 such that the rotating force of shaft 24 induces a rotating motion in flywheel 16 and forces at least one tactile feedback interface member to rotate about flywheel 16. Apparatus 10 may also include a position sensor to provide feedback to motor 20 on location of motor 20 relative to the tactile feedback interface member. In this embodiment of the present invention, the tactile feedback interface members are pedals 18. The rotating motions induced in pedals 18 forces pedals 18 to rotate about flywheel 16 without any human interaction at pedals 18 (see FIG. 2A). A programmable computer may also be included with apparatus 10 to provide an individual with the ability to allow a computer program to control the operation, for example, the speed at all locations, of motor 20. A seat 14 may also be included in apparatus 10 to provide support to the individual during a period of exercise.

In this particular embodiment of the present invention, a stack of weight plates 26 and/or a spring (not shown) may be added to exercise apparatus 10 as a means of providing a resistance for the individual riding the exercise bicycle. Similar to the belt/flywheel relationship described above to adjust the amount of resistance the individual is to overcome to rotate pedals 180 relative to drive assembly 160, weights plates 26 will provide a resistance, but in a different manner as presented below. In this instance, a cable 28 may be used to connect a cuff 34, cuff 34 being secured at the ankles of an individual during exercise (see FIG. 3A), to weight plates 26. Pulleys 30 may be added to apparatus 10 to guide cables 28 from cuff 34 to plates 26 as illustrated in FIGS. 2A-9C. Pulleys 30 enable cable 28 to glide smoothly as cuffs 34 attached to ankles of individual are rotated at pedals 18 about flywheel 16. An adjustable pulley 30*a* may also be included in apparatus 10 to allow pulleys 30*a* and cable 28 to be easily adjusted by the individual to modify the exercise motion for optimize muscle development. Pulleys 30 also translate the rotational motion of the feet following pedals 18 about flywheel 16 to a lateral motion of weight plates 26 about frame 12.

Along with adjusting the amount of weight moved at weight plates 26, the location of pedals 18 may also be adjusted about an arm 36, arm 36 having a first end secured at flywheel 16 and a second end secured at pedals 18. Multiple holes 54*c*, 54*d*, 54*e*, 54*f*, 54*g* may be included in arms 36*a*, 36*b* to allow for the repositioning of pedals 18 relative to flywheel 16. The position of pedals 18 may be positioned about arm 26 as illustrated in FIG. 2A and FIGS. 10A-10C to change the range of motion the feet and legs will rotate through to further enhance muscle development and rehabilitation.

Furthermore, the position of pedals 18 may be varied between arms 36*a*, 36*b*. For example, pedal 18 on arm 36*a* may be positioned at hole 54*e* and pedal 18 on arm 36*b* may be positioned at hole 54*c*. The varying the position of pedals 18 allow the individual or a prescribing physical therapist to exercise the muscle groups of each leg differently. For example, one leg may be responding better to the exercises than the other leg and the leg responding better to the exercises may be capable of a larger range of motion than the other leg. This will allow both legs to be worked out at the same time, but allow for different levels of training, thereby cutting down on the overall time devoted to the workout.

Cables 28 are always in tension and applying a load to the ankles through cuffs 34 as the feet follow the individual rotating pedals. As individual rotates pedals 18 to the furthest distance away from weight plates 26, cuffs 34 attached to cables 28 will pull weight plates 26 upward from the lowest position near base 32. As individual rotates pedals 18 to the nearest distance to weight plates 26, cables 28 will lower weight plates 26 to the lowest position just above base 32. Further, separate weight plates 26 may be anchored to each of the two cuffs 34. Weight plate 26*a* may be anchored to cuff 34*a* by cable 28*a*. Weight plates 26*b* may be anchored to cuff 34*b* by cable 28*b*. The feet, following the continued rotation of pedals 18 by individual about flywheel 16, will move weight plates 26 from its lowest position just above base 32 to an upward position and back to its lowest position just above base 32. Weight plates 26*a*, 26*b* may be alternating positions as individual keeps pedals 18 in continuation motion about flywheel 16. When weight plates 26*a* are at a highest position relative to base 32, weight plates 26*b* will be at its lowest position slightly above base 32. As individual continues following rotating pedals 18 about flywheel 16, weight plates 26*a*, 26*b* may pass one another as weight plates 26*a*, 26*b* move from the highest position to the lowest position slightly above base 32.

An individual may need to exert more effort in terms of energy by the human body to maintain contact with pedals 18 as the load from weight plates 26 is increased. The increase in effort exerted by the individual to ensure feet maintain contact with pedals 18 while ankles are secured to weight plates 26 by cables 28, results in increased use of the subject muscles in the legs leading to fatigue of the muscles which results in overall development of the muscles. Further, the leg muscles extend or lengthen as the legs work to lift the weights and the leg muscles contract or shorten as the legs work to lower the weights. Apparatus 100 illustrated in FIG. 1 works the muscles in the leg only when the leg muscles are extending or lengthening, for example, when the foot and pedal are moving away from the body. Apparatus 100 does not work the muscles in the leg when the muscles are contracting or shortening, for example, when the foot and pedal are moving toward the body. In a typical exercise apparatus utilizing weight plates, the amount of resistance may be adjusted by selecting the number of weight plates the individual desires to move. Generally, an increase in the number of weight plates secured to the weight stack will increase the weight and overall resistance the individual must overcome to move the weight stack. The same concept may be used in this particular embodiment of the present invention. The prescribing physical therapist or individual user of exercise apparatus 10 may determine how much resistance to be increased at the ankles when rotating pedals 18 by selecting the number of weight plates 26 lifted from base 32. Allowing for an adjustment in the weight to be moved, will provide for a broader range of exercise capability. Furthermore, for a leg having a disability, and individual has the option to exercise the leg exhibiting the disability with lower weights and a shorter stroke on the apparatus at the same time the other leg is being exercised with more weight and a longer stroke. This cannot be accomplished on apparatus 100.

Furthermore, the number of weight plates 26 and, therefore, the amount of weight on each of the separate stack of weight plates 26*a*, 26*b* may be varied. Varying the amount of weight on each of the stacks will allow the individual or a prescribing physical therapist to exercise the muscle groups of each leg differently. For example, one leg may be responding better to the exercises than the other leg and the leg responding better to the exercises may be capable of moving more weight than the other leg. This will allow both legs to be worked out at the same time, but allow for different levels of training, thereby cutting down on the overall time devoted to the workout. Other prior art exercise equipment does not offer this option.

As stated above, motor 20 is connected to flywheel 16 by shaft 24 through belt 52. When motor 20 is energized, a rotational motion is induced in shaft 24 which moves belt 52 and, in turn, rotates flywheel 16 and pedals 18. With the feet of an individual positioned on pedals 18, the rotational motion induced in pedals 18 by motor 20 will enable the feet to follow pedals 18 through tactile feedback provided by pedals 18 against the feet. As the feet follow pedals 18, cuffs 34 attached at the ankles will pull on cables 28 and force weight plates 26 to move from the lowest position just above base 32 to the highest position and back to the lowest position just above base 32 again. After the individual sets the location of each pedal 18 relative to the center of rotation, selects the amount of weight to be moved at weights stacks 26 and sets the speed of motor 20, the individual merely needs to ensure feet maintain contact with pedals 18 to exercise the muscles of the legs. Apparatus 10 will control the speed and path that each pedal 18 travels through. Apparatus 10 allows each leg to achieve a different exercise workout at the same time which apparatus 100 illustrated in FIG. 1 does not accomplish.

In another embodiment of the present invention illustrated in FIGS. 2B, 3B, 4, 6B and 11A-11C, the drive guidance assembly includes drive plates 44*a*, 44*b*, bearings 46*a*, 46*b*, and a flywheel 48. Drive plates 44*a*, 44*b*, bearings 46*a*, 46*b*, and a flywheel 48 may be substituted for cover 62 and flywheel 16. In this particular embodiment of the present invention, the tactile feedback interface member such as pedals 18 may be secured directly to drive plates 44*a*, 44*b*. Multiple holes 50*c*, 50*d*, 50*e*, 50*f* may be included on the surface of each of drive plates 44*a*, 44*b* to allow for the repositioning of pedals relative to flywheel 48. Allowing for the repositioning of pedals 18 relative to flywheel 48 will enable the individual to vary the range of motion the feet will travel through thereby allowing the therapist or user to adapt the range of motion to the ability of the user to optimize the workout of the leg muscles. Apparatus 100 illustrated in FIG. 1 does not provide this option.

Furthermore, the position of pedals 18 may be varied between plates 44*a* and 44*b*. For example, pedal 18 on plate 44*a* may be positioned at hole 50*e* and pedal 18 on plate 44*b* may be positioned at hole 50*c*. The varying the position of pedals 18 allow the individual or a prescribing physical therapist to exercise the muscle groups of each leg differently. For example, one leg may be responding better to the exercises than the other leg and the leg responding better to the exercises may be capable of a larger range of motion than the other leg. This will allow both legs to be worked out at the same time, but allow for different levels of training, thereby cutting down on the overall time devoted to the workout. Apparatus 100 illustrated in FIG. 1 does not provide this option.

Further, the position of seat 14 relative to pedals 18 may be adjusted to move individual closer to or further from pedals 18. The height of seat 14 may be raised or lowered to ensure a proper fit for all the different sizes and shapes of individuals and to provide for optimal muscle development and rehabilitation. Still further, the speed of motor 20 may be increased or decreased which, in turn, will increase or decrease the rotation speed of pedals 18 about flywheel 16. Using a stepper motor will enable one to program, through the programmable computer of apparatus 10, a consistently variable speed of rotation in the stepper motor as the stepper motor rotates through the 360 degrees of rotation. The stepper motor could be programmed to stop for a period of time at one or more locations along the path of the stepper motor. The position senor may also be used to feedback to the stepper motor the location of the stepper motor relative to the location pedals 18. Similar to weight adjustments, speed adjustments will enable a wider range of exercise capability. Apparatus 100 illustrated in FIG. 1 does not provide this option.

In this particular embodiment of the present invention, the feet of the individual using exercise apparatus 10 follow the path of the motor driven pedals 18. The contact of the feet on the pedals provides the body a tactile feedback that tells the body to follow the path of pedals 18 as the weight attached at the ankles is moved by the individual. As motor 20 controls the speed of the rotation of pedals 18, the feet of the individual will keep up with the speed set by motor 20 and move the amount of weight set at weight plates 26. The intent is not to have the individual apply energy to move their legs to rotate pedals 18, but to allow the tactile feedback provided by the feet against pedals 18 to move the feet along the rotation path of pedals 18 and resist the load provided by weight plates 26. The load provided by weight plates 26 at the ankles forces the body to expend energy as the feet follow the rotation path of pedals 18. Apparatus 100 illustrated in FIG. 1 does not provide this option.

The working muscles in the instant embodiment, the muscles of the legs, are under a continuous load created by the attachment of the weights at the ankles as the legs rotate about flywheel 16. This result is both a dynamic isotonic concentric and dynamic isotonic eccentric motor guided exercise apparatus. Isotonic concentric movements occur when the working muscles shorten. Isotonic eccentric movements occur when the working muscles lengthen. In this particular embodiment of the present invention, pedals 18 rotated by motor 20 is used to guide the feet through a fixed path at a fixed speed. As stated above, both the speed of motor 20 and the size of the path pedals 18 rotate about flywheel 16 may be adjusted to optimize muscle development. Tactile feedback ensures the feet stay in constant contact with pedals 18 while pedals 18 are rotated by motor 20 through flywheel 16. In contrast, other forms of exercise, such as walking and running for example, only work the muscles under isotonic concentric movements, when the muscles are shortening. Other forms of exercise, biking and climbing stairs for example, only work muscles under isotonic eccentric movements, when the muscles are lengthening. The present invention provides for both dynamic isotonic concentric and dynamic isotonic eccentric muscle movements during the same exercise. For an equal number of exercise cycles to the tradition exercises listed above, the present invention will enable the individual to expend twice the energy and achieve twice the effective workout compared to biking, stair climbing, walking, running and like exercises. Apparatus 100 illustrated in FIG. 1 does not provide this option.

Furthermore, the feet, being in light tactile contact with pedals 18, enables the feet to continually, repeatably and in a controlled manner follow the travel path. The travel distance per cycle and the travel speed at every point of the total travel path may also be controlled in a continual and repeatable manner while exercising the working muscle. The constant rotational speed of motor 20, flywheel 16 and pedals 18 may limit the acceleration of weight plates 26 being lifted and the deceleration of weight plates 26 being lowered. Any additional load caused by the acceleration and deceleration of weight plates 26 may be minimized. Apparatus 100 illustrated in FIG. 1 does not provide this option.

The force to lift the weight from the stack is equal to the weight of stacked weight plates 26 plus the acceleration of the mass of stacked weight plates 26. The muscles in the legs work against this force. Because the rotational speed of motor 20 may be constant, the acceleration of weight plates 26 is controlled and may be minimized, which reduces the force of the acceleration on the muscles, tendons, ligaments and bones. In contrast, other forms of lifting stacked weight plates, such as a bench or shoulder press, arm curl and the like, do not control the speed or acceleration the individual exerts to move the weight plates. This may result in an increase in the force to initially move the weights and this uncontrolled movement and increased force on the particular body part that may lead to injury.

The force to lower the weight to the lowest position of the travel of the stack is equal to the weight of stacked weight plates 26 plus the deceleration of the mass of the falling stacked weight plates 26. The muscles in the legs work against this force. Because the rotational speed of motor 20 may be constant, the deceleration of weight plates 26 is controlled and may be minimized, which reduces the force of the deceleration on the muscles, tendons, ligaments and bones. In contrast, other forms of lifting stacked weight plates, such as a bench or shoulder press, arm curl and the like do not control the speed or deceleration the individual exerts to lower the weight plates. This may result in an increase in the force to lower the weights and this uncontrolled movement and increased force on the particular body part that may lead to injury.

As described above, a fixed force, such as weight plates 26 may be used as a means to increase and decrease the load an individual will work against to increase muscle tone. A variable force, such as springs or bands 102*a*, 102*b* or a combination of a fixed force or variable force may be used in with motorized exercise apparatus 10 achieve the goal of working the muscles to a point of fatigue thereby facilitating faster muscle development, shortening muscle rehabilitation and decreasing the overall recovery period.

Another typical prior art exercise apparatus uses a flywheel and friction to work the arm muscles as the feet now push the pedals through a rotational path. Still another typical prior art exercise apparatus may use a motor to move the pedals through the rotational path at a fixed speed. In this particular exercise apparatus, the feet may be attached to the to the pedals and the motor drags the feet through the rotational path because the muscles of the legs are unable to move the pedals.

Figure 7:
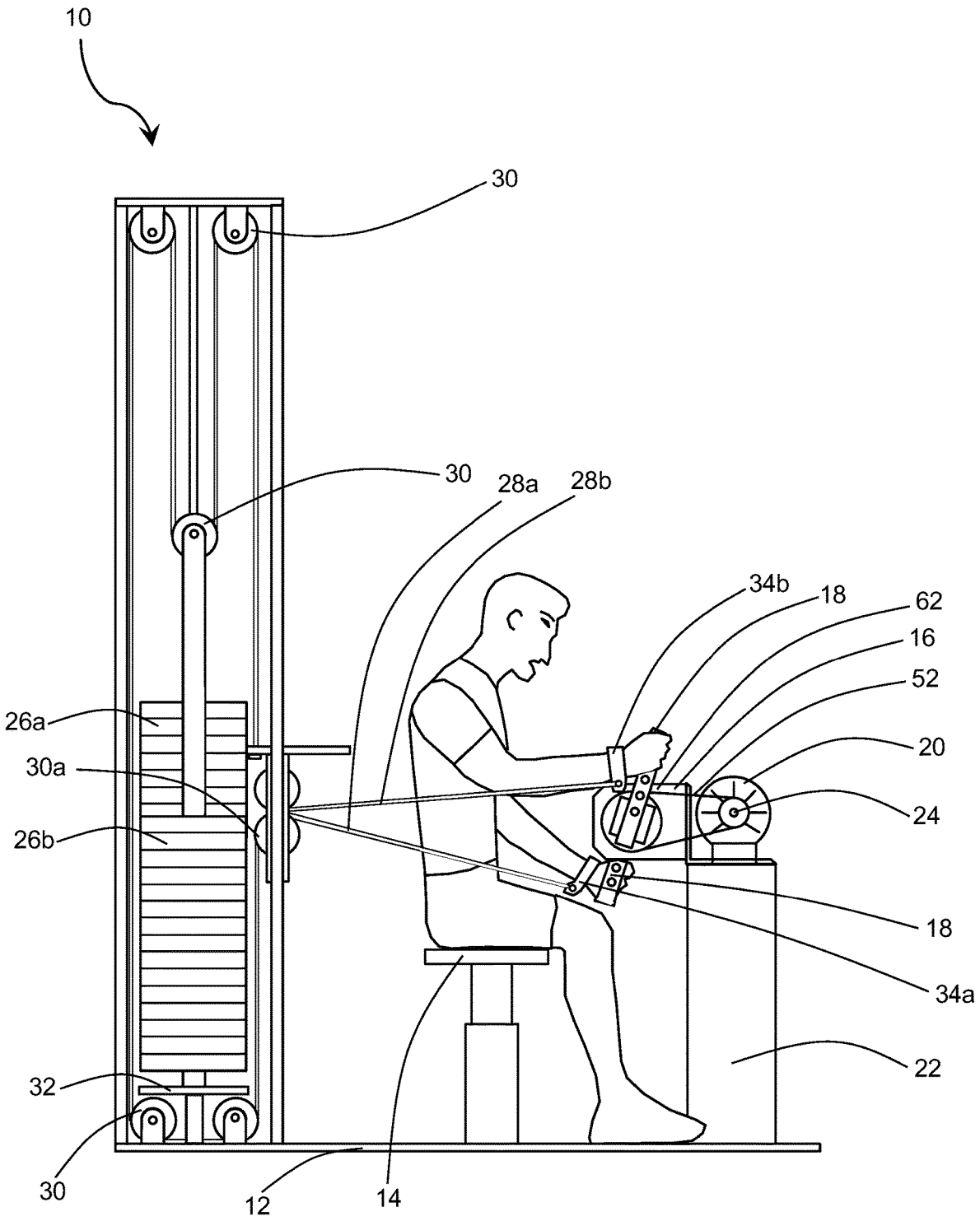
FIG. 7 is a side view of an isometric, dynamic isotonic concentric and dynamic isotonic eccentric motorized guidance exercise apparatus according to yet another embodiment of the present invention.

According to another embodiment of the present invention, a motor 20 may be added to an upper body cyclic ergometer used to exercise the muscles of the arms to enable motorized guidance exercise apparatus 10 illustrated in FIG. 7. Similar to above, Motor 20 is supported and secured to frame 12 at stanchion 22. Motor 20 is further secured to a drive guidance assembly by belt 52. In this embodiment of the present invention, the drive guidance assembly includes a cover 62 and a flywheel 16 (see FIGS. 3A and 10A-10C). Motor 20 may be any type of motor including but not limited to a typical induction motor, a direct drive motor, a linear motor, a servo motor, a stepper motor and the like that may be connected to a power supply such that when motor 20 is energized, a shaft 24 of motor 20 is rotated within motor 20. Shaft 24 may be connected to flywheel 16 through belt 52 such that the rotating force of shaft 24 induces a rotating motion in flywheel 16 and forces at least one tactile feedback interface member to rotate about flywheel 16. Apparatus 10 may also include a position sensor to provide feedback to motor 20 on location of motor 20 relative to the tactile feedback interface member. In this embodiment of the present invention, the tactile feedback interface members are pedals 18. The rotating motions induced in pedals 18 forces pedals 18 to rotate about flywheel 16 without any human interaction at pedals 18. A programmable computer may also be included with apparatus 10 to provide an individual with the ability to allow a computer program to control the operation, for example, the speed at all locations, of motor 20. A seat 14 may also be included in apparatus 10 to provide support to the individual during a period of exercise.

In this particular embodiment of the present invention, a stack of weight plates 26 and/or a spring (not shown) may be added to exercise apparatus 10 as a means of providing a resistance for the individual using the upper body cycle to exercise the muscles of the arms. Similar to the belt/flywheel relationship described above to adjust the amount of resistance the individual is to overcome to rotate pedals 180 relative to drive assembly 160, weights plates 26 will provide a resistance, but in a different manner as presented below. In this instance, a cable 28 may be used to connect a cuff 34, cuff 34 being secured at the wrists of an individual during exercise, to weight plates 26. Pulleys 30 may be added to apparatus 10 to guide cables 28 from cuff 34 to weight plates 26. An adjustable pulley 30*a* may also be included in apparatus 10 to allow pulleys 30*a* and cable 28 to be easily adjusted by the individual to modify the exercise motion for optimize muscle development. Pulleys 30 enable cable 28 to glide smoothly as cuffs 34 attached to wrists of individual are rotated at pedals 18 about flywheel 16. Pulleys also translate the rotational motion of hands following pedals 18 about flywheel 16 to a lateral motion of weight plates 26 about frame 12.

Cables 28 are always in tension and applying a load to the wrists through cuffs 34 at the hands follow the individual rotating pedals 18. As individual rotates pedals 18 to the furthest distance away from weight plates 26, cuffs 34 attached to cables 28 will pull weight plates 26 upward from the lowest position near base 32. As individual rotates pedals 18 to the nearest distance to weight plates 26, cables 28 will lower weight plates 26 to the lowest position just above base 32. Further, separate weight plates 26 may be anchored to each of the two cuffs 34. Weight plate 26*a* may be anchored to cuff 34*a* by cable 28*a*. Weight plates 26*b* may be anchored to cuff 34*b* by cable 28*b*. The hands following the continued rotation of pedals 18 by individual about flywheel 16 will move weight plates 26 from its lowest position just above base 32 to an upward position and back to its lowest position just above base 32. Weight plates 26*a*, 26*b* may be alternating positions while as individual keeps pedals 18 in continuation motion about flywheel 16. When weight plates 26*a* are at a highest position relative to base 32, weight plates 26*b* will be at its lowest position slightly above base 32. As individual continues rotating pedals 18 about flywheel 16, weight plates 26*a*, 26*b* may pass one another as weight plates 26*a*, 26*b* move from the highest position to the lowest position slightly above base 32.

An individual may need to exert more effort in terms of energy by the human body to maintain contact with pedals 18 as the load from weight plates 26 is increased. The increase in effort exerted by the individual to ensure hands maintain contact with pedals 18 while wrists are secured to weight plates 26 by cables 28 results in increased use of the subject muscles in the arms leading to fatigue of the muscles which results in overall development of the muscles. In a typical exercise apparatus utilizing a weight plates, the amount of resistance may be adjusted by selecting the number of weight plates the individual desires to move. Generally, an increase in the number of weight plates secured to the stack will increase the weight and overall resistance the individual must overcome to move the stack. The same concept may be used in this particular embodiment of the present invention. The prescribing physical therapist or individual user of exercise apparatus 10 may determine how much resistance to be increased at the wrists when rotating pedals 18 by selecting the number of weight plates 26 lifted from base 32. Allowing for an adjustment in the weight to be moved, will provide for a broader range of exercise capability.

Furthermore, the number of weight plates 26 and, therefore, the amount of weight on each of the separate stack of weight plates 26*a*, 26*b* may be varied. Varying the amount of weight on each of the stacks will allow the individual or a prescribing physical therapist to exercise the muscle groups of each arm differently. For example, one arm may be responding better to the exercises than the other arm and the arm responding better to the exercises may be capable of moving more weight than the other arm. This will allow both arms to be worked out at the same time, but allow for different levels of training, thereby cutting down on the overall time devoted to the workout. Other prior art exercise equipment does not offer this option.

As stated above, motor 20 is connected to flywheel 16 by shaft 24 through belt 52. When motor 20 is energized, a rotational motion is induced in shaft 24 which moves belt 52 and, in turn, rotates flywheel 16 and pedals 18. With the hands of an individual positioned on pedals 18, the rotational motion induced in pedals 18 by motor 20 will continuously pull on cables 28 attached to cuffs 34 at the wrists of the individual as described above and move weight plates 26 in a lateral motion about frame 12 from the lowest position just above base 32 to the highest position and back to the lowest position just above base 32 again. An individual using exercise apparatus 10 with assistance from motor 20 to rotate pedals 18, merely needs to place their hands on pedals 18 and pedals 18 will guide the particular extremity of the body under exercise, in this case the arms.

Figure 10A:
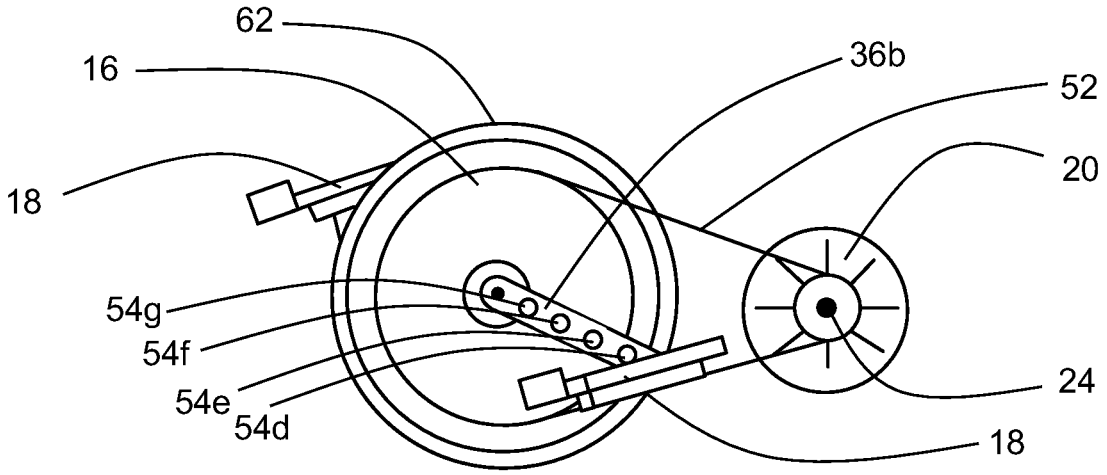
FIGS. 10A-10C are side views of an adjustable pedal system of the motorized guidance exercise apparatus according to an embodiment of the present invention.
Figure 10B:
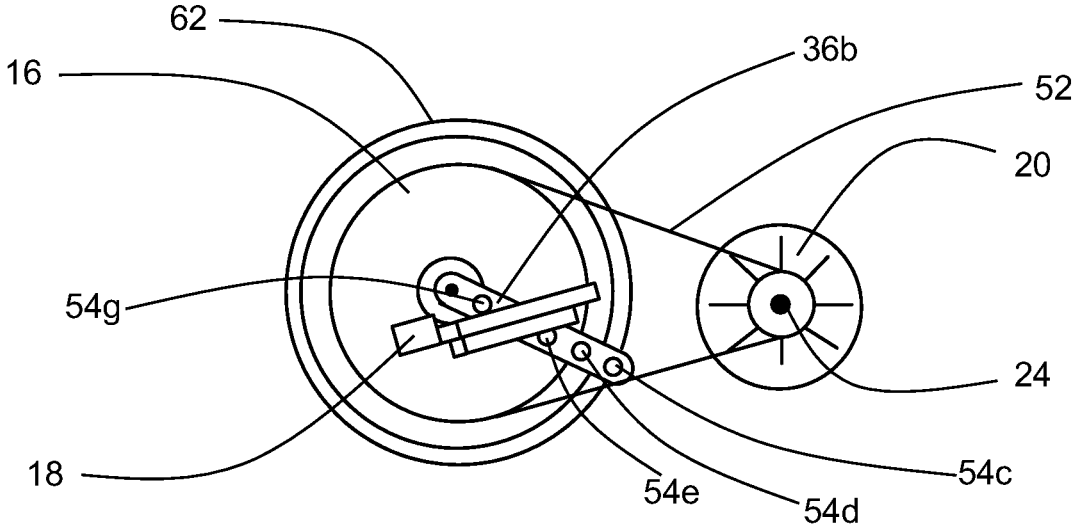
Figure 10C:
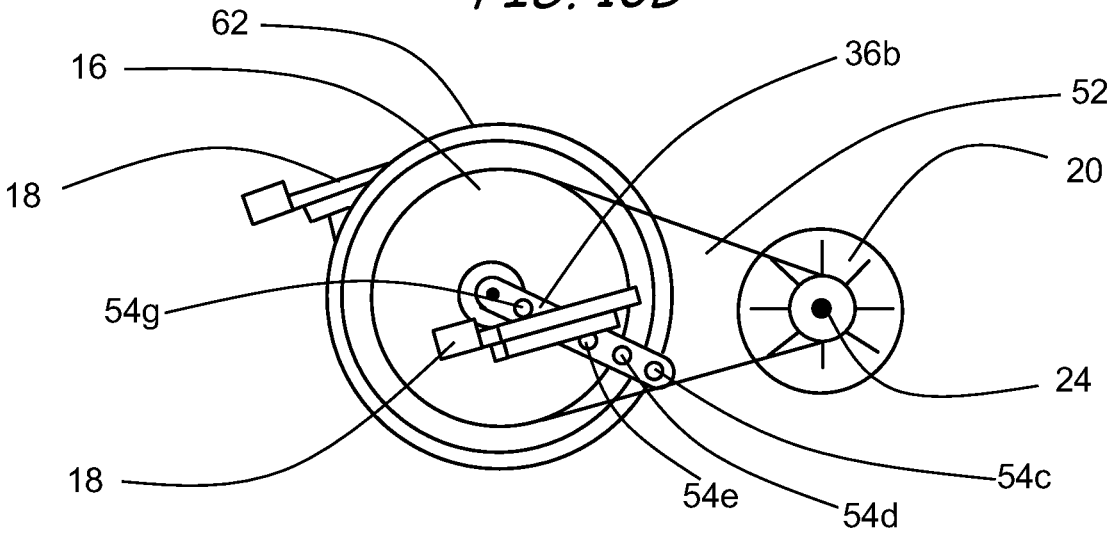
Figure 11A:
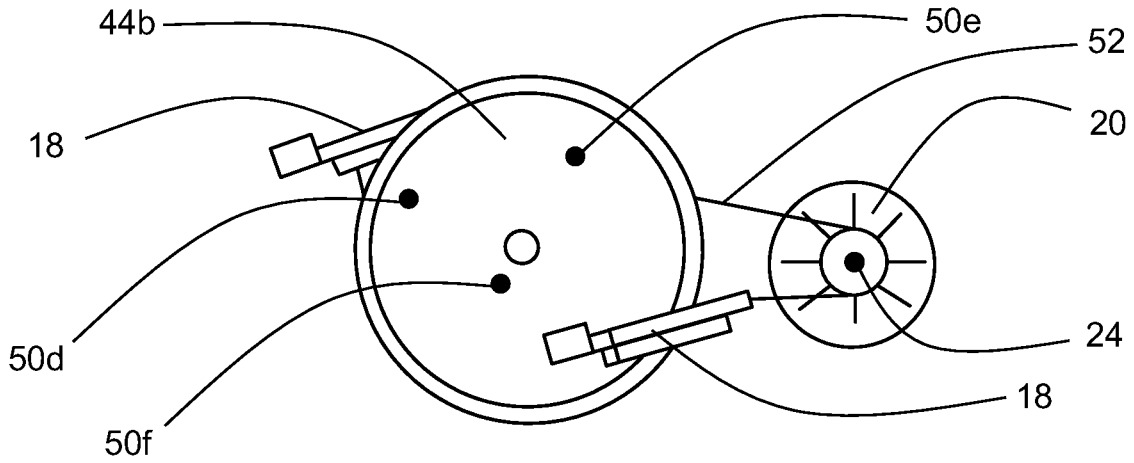
FIGS. 11A-11C are side views of an adjustable pedal system of the motorized guidance exercise apparatus according to another embodiment of the present invention.
Figure 11B:
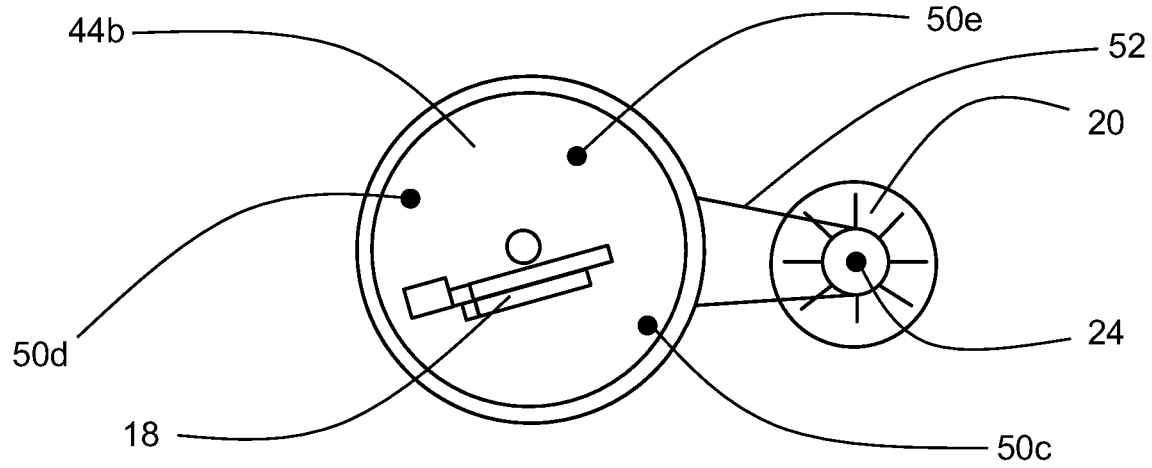
Figure 11C:
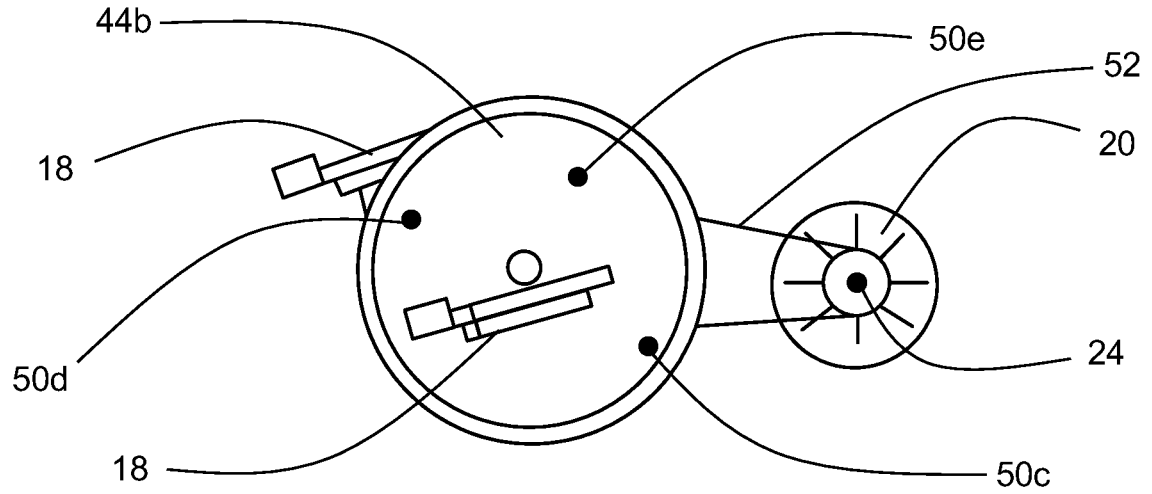
Figure 12A:
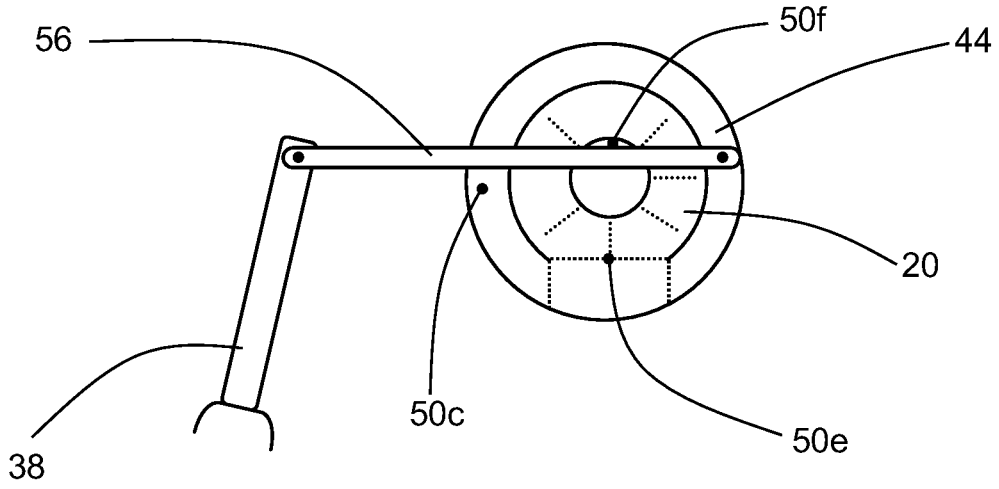
FIGS. 12A-12C are side views of an adjustable linkage system of the motorized guidance exercise apparatus according to yet another embodiment of the present invention.
Figure 12B:
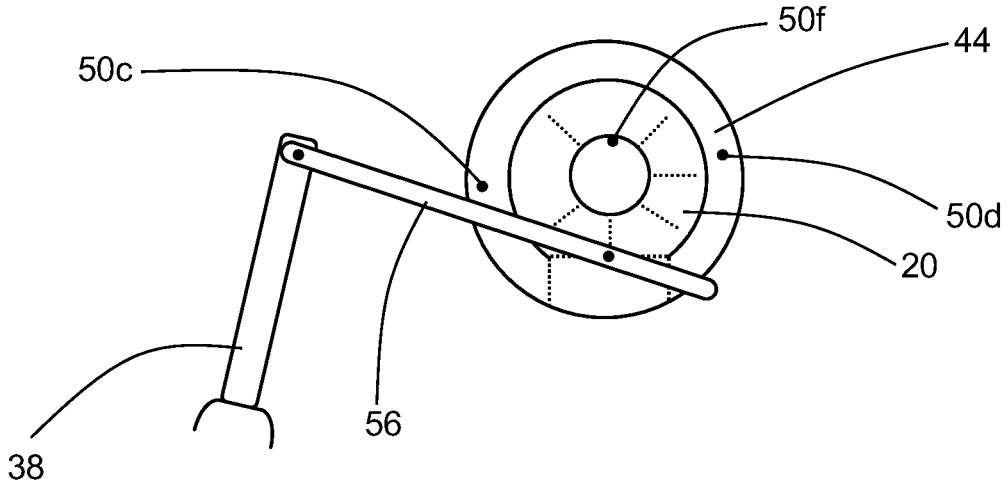
Figure 12C:
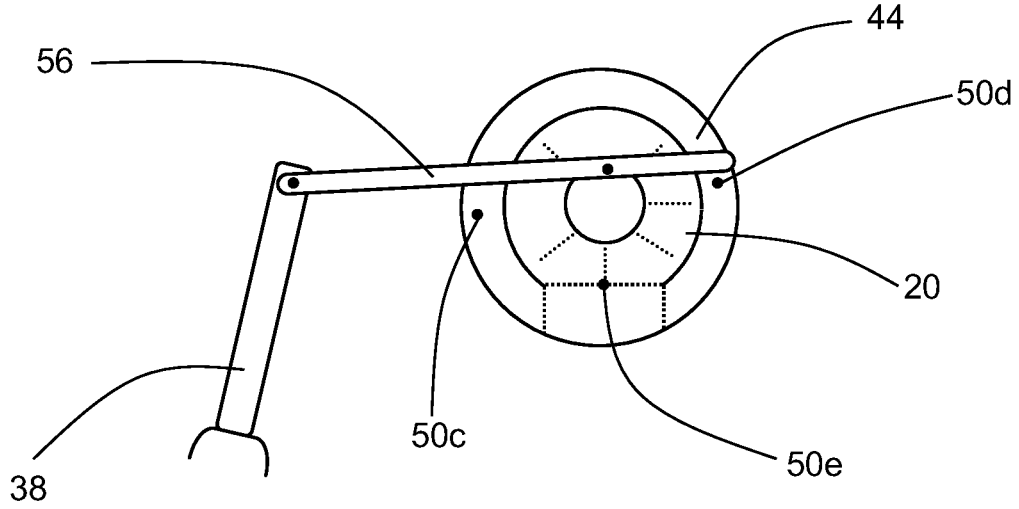

Along with adjusting the amount of weight moved at weight plates 26, the location of pedals 18 may also be adjusted about an arm 36, arm 36 having a first end secured at flywheel 16 and a second end secured at pedals 18. Multiple holes 54*c*, 54*d*, 54*e*, 54*f*, 54*g* may be included in arms 36*a*, 36*b* to allow for the repositioning of pedals relative to flywheel 16. The position of pedals 18 may be positioned about arm 36 as illustrated in FIGS. 10A-10C to change the range of motion the hands and arms will rotate through to further enhance muscle development and rehabilitation.

Furthermore, the position of pedals 18 may be varied between arms 36*a*, 36*b*. For example, pedal 18 on arm 36*a* may be positioned at hole 54*e* and pedal 18 on arm 36*b* may be positioned at hole 54*c*. The varying the position of pedals 18 allow the individual or a prescribing physical therapist to exercise the muscle groups of each arm differently. For example, one arm may be responding better to the exercises than the other arm and the arm responding better to the exercises may be capable of a larger range of motion than the other arm. This will allow both arms to be worked out at the same time, but allow for different levels of training, thereby cutting down on the overall time devoted to the workout.

In yet another embodiment of the present invention illustrated in FIGS. 6B and 11A-11C, the drive guidance assembly includes drive plates 44*a*, 44*b*, bearings 46*a*, 46*b*, and a flywheel 48. Drive plates 44*a*, 44*b*, bearings 46*a*, 46*b*, and a flywheel 48 may be substituted for cover 62 and flywheel 16. In this particular embodiment of the present invention, the at least one tactile feedback interface members, pedals 18, may be secured directly to drive plates 44*a*, 44*b*. Multiple holes 50*c*, 50*d*, 50*e*, 50*f* may be included on the surface of each of drive plates 44*a*, 44*b* to allow for the repositioning of pedals relative to the center of rotation. Allowing for the repositioning of pedals 18 relative to the center of rotation will enable the individual to vary the range of motion the hands will travel through thereby allowing the therapist or user to adapt the range of motion to the ability of the user to optimize the workout of the arm muscles.

Furthermore, the position of pedals 18 may be varied between plates 44*a* and 44*b*. For example, pedal 18 on plate 44*a* may be positioned at hole 50*e* and pedal 18 on plate 44*b* may be positioned at hole 50*c*. The varying the position of pedals 18 allow the individual or a prescribing physical therapist to exercise the muscle groups of each arm differently. For example, one arm may be responding better to the exercises than the other arm and the arm responding better to the exercises may be capable of a larger range of motion than the other arm. This will allow both arms to be worked out at the same time, but allow for different levels of training, thereby cutting down on the overall time devoted to the workout.

Further, the position of seat 14 relative to pedals 18 may be adjusted to move individual closer to or further from pedals 18. The height of seat 14 may be raised or lowered to ensure a proper fit for all the different sizes and shapes of individuals and to provide for optimal muscle development and rehabilitation. Still further, the speed of motor 20 may be increased or decreased which, in turn, will increase or decrease the rotation speed of pedals 18 about flywheel 16. Similar to weight adjustments, speed adjustments will enable a wider range of exercise capability.

In this particular embodiment of the present invention, the hands of the individual using exercise apparatus 10 follow the path of the motor driven pedals 18. The contact of the hands on the pedals provides the body a tactile feedback that tells the body to follow the path of pedals 18 as the weight attached at the wrists is moved by the individual. As motor 20 controls the speed of the rotation of pedals 18, the hands of the individual will keep up with the speed set by motor 20 and move the amount of weight set at weight plates 26. The intent is not to have the individual apply energy to move their arms to rotate pedals 18, but to allow the tactile feedback provided by the hands against pedals 18 to move the hands along the rotation path of pedals 18 and resist the load provided by weight plates 26. The load provided by weight plates 26 at the wrists forces the body to expend energy as the hand follow the rotation path of pedals 18.

The working muscles in the instant embodiment, the muscles of the arms, are under a continuous load created by the attachment of the weights at the wrists as the arms rotate about flywheel 16. This result is both a dynamic isotonic concentric and dynamic isotonic eccentric motor guided exercise apparatus. Isotonic concentric movements occur when the working muscles shorten. Isotonic eccentric movements occur when the working muscles lengthen. In this particular embodiment of the present invention, pedals 18 rotated by motor 20 is used to guide the hands through a fixed path at a fixed speed. As stated above, both the speed of motor 20 and the size of the path pedals 18 rotate about flywheel 16 may be adjusted to optimize muscle development. Tactile feedback ensures the hands stay in constant contact with pedals 18 while pedals 18 are rotated by motor 20 through flywheel 16. In contrast, other forms of exercise, such as walking and running for example, only work the muscles under isotonic concentric movements, when the muscles are shortening. Other forms of exercise, biking and climbing stairs for example, only work muscles under isotonic eccentric movements, when the muscles are lengthening. The present invention provides for both dynamic isotonic concentric and dynamic isotonic eccentric muscle movements during the same exercise. For an equal number of exercise cycles to the tradition exercises listed above, the present invention will enable the individual to expend twice the energy and achieve twice the effective workout compared to biking, stair climbing, walking, running and like exercises.

Furthermore, the hands, being in light tactile contact with pedals 18, enables the hands to continually, repeatably and in a controlled manner follow the travel path. The travel distance per cycle and the travel speed at every point of the total travel path may also be controlled in a continual and repeatable manner while exercising the working muscle. The constant rotational speed of motor 20, flywheel 16 and pedals 18 may limit the acceleration of weight plates 26 being lifted and the deceleration of weight plates 26 being lowered. Any additional load caused by the acceleration and deceleration of weight plates 26 may be minimized.

The force to lift the weight from the stack is equal to the weight of stacked weight plates 26 plus the acceleration of the mass of stacked weight plates 26. The muscles in the arms work against this force. Because the rotational speed of motor 20 may be constant, the acceleration of weight plates 26 is controlled and may be minimized, which reduces the force of the acceleration on the muscles, tendons, ligaments and bones. In contrast, other forms of lifting stacked weight plates, such as a bench or shoulder press, arm curl and the like, do not control the speed or acceleration the individual exerts to move the weight plates. This may result in an increase in the force to initially move the weights and this uncontrolled movement and increased force on the particular body part that may lead to injury.

The force to lower the weight to the lowest position of the travel of the stack is equal to the weight of stacked weight plates 26 plus the deceleration of the mass of the falling stacked weight plates 26. The muscles in the arms work against this force. Because the rotational speed of motor 20 may be constant, the deceleration of weight plates 26 is controlled and may be minimized, which reduces the force of the deceleration on the muscles, tendons, ligaments and bones. In contrast, other forms of lifting stacked weight plates, such as a bench or shoulder press, arm curl and the like do not control the speed or deceleration the individual exerts to lower the weight plates. This may result in an increase in the force to lower the weights and this uncontrolled movement and increased force on the particular body part that may lead to injury.

As described above, a fixed force, such as weight plates 26 may be used as a means to increase and decrease the load an individual will work against to increase muscle tone. A variable force, such as springs or bands or a combination of a fixed force or variable force may be used in with motorized exercise apparatus 10 achieve the goal of working the muscles to a point of fatigue thereby facilitating faster muscle development, shortening muscle rehabilitation and decreasing the overall recovery period.

In still another embodiment of the present invention, exercise apparatus 10 may be adapted to a traditional weight machine 40 and used to improve the muscles in the chest, arms, neck, back, shoulder, legs and the like. FIGS. 8A-8D illustrate motorized exercise apparatus 10 adapted to exercise the muscles of the upper body in the chest, back, neck and arms. In the particular embodiment, motor 20 may be added to weight machine 40 to enable another embodiment of motorized guidance exercise apparatus 10. As above, motor 20 is supported and secured to frame 12 at stanchion 22. In this particular embodiment of the present invention, motor 20 is further secured to a tactile feedback interface member. The tactile feedback interface members of this particular embodiment of the present invention are handles 38 of weight machine 40. Handles 38 are secured to motor 20 by a bar 56. Motor 20 may be any type of motor including but not limited to a typical induction motor, a direct drive motor, a linear motor, a servo motor, a stepper motor and the like that may be connected to a power supply such that when motor 20 is energized, drive plate 44 of motor 20 is rotated about motor 20. Apparatus 10 may also include a position sensor to provide feedback to motor 20 on location of motor 20 relative to handles 38. Drive plate 44 may be connected to bar 56 and handles 38 such that the rotating force of drive plate 44 induces a rotating motion in handles 38 and forces handles 38 into a lateral motion relative to weight machine 40 without any human interaction at handles 38. A programmable computer may also be included with apparatus 10 to provide an individual with the ability to allow a computer program to control the operation, for example, the speed at all locations, of motor 20.

In this particular embodiment of the present invention, a stack of weight plates 26 is present as a means of providing a resistance for the individual as the hands follow the path of handles 38 travel through. In this instance, a cable 28 may be used to secure a cuff 34, secured at the wrists of an individual during exercise, to weight plates 26. Pulleys 30 may be added to apparatus 10 to guide cables 28 from cuff 34 to weight plates 26 as described above. An adjustable pulley 30*a* may also be included in apparatus 10 to allow pulleys 30*a* and cable 28 to be easily adjusted by the individual to modify the exercise motion for optimize muscle development. Pulleys 30 enable cable 28 to glide smoothly as cuffs 34 attached to wrists of individual as the hands follow the path of handles 38 as handles 38 are moved away from the body and brought toward the body as motor 20 drives handles 38.

As the hands of the individual follow the path of handles 38, cables 28 are always in tension and applying a load to the wrists through cuffs 34. As the hands of the individual follow the path of handles 38 to the furthest distance away from weight plates 26, cables 28 will pull weight plates 26 upward from the lowest position near base 32. As handles 38 move toward the body and to the nearest distance to weight plates 26, cables 28 will lower weight plates 26 to the lowest position just above base 32. Further, separate weight plates 26 may be anchored to each of the two cuffs 34. Weight plate 26*a* may be anchored to cuff 34*a* by cable 28*a*. Weight plates 26*b* may be anchored to cuff 34*b* by cable 28*b*. As the hands of the individual continue to follow the path of handles 38, handles 38 will move weight plates 26 from its lowest position just above base 32 to an upward position and back to its lowest position just above base 32. Weight plates 26*a*, 26*b* may be alternating positions while as individual keeps handles 38 in continuation motion about motor 20. When weight plates 26*a* are at a highest position relative to base 32, weight plates 26*b* will be at its lowest position slightly above base 32. As the hands of the individual continue to follow the path of handles 38 about motor 20, weight plates 26*a*, 26*b* may pass one another as weight plates 26*a*, 26*b* move from the highest position to the lowest position slightly above base 32.

An individual may need to exert more effort in terms of energy by the human body to maintain contact with handles 38 as the load from weight plates 26 is increased. The increase in effort exerted by the individual to ensure hands maintain contact with handles 38 while wrists are secured to weight plates 26 by cables 28 results in increased use of the subject muscles in the chest, back and arms leading to fatigue of the muscles which results in overall development of the muscles. In a typical exercise apparatus utilizing weight plates, the amount of resistance may be adjusted by selecting the number of weight plates the individual desires to move. Generally, an increase in the number of weight plates secured to the stack will increase the weight and overall resistance the individual must overcome to move the stack. The same concept may be used in this particular embodiment of the present invention. The prescribing physical therapist or individual user of exercise apparatus 10 may determine how much resistance to be increased at the wrists when pressing handles 38 by selecting the number of weight plates 26 lifted from base 32. Allowing for an adjustment in the weight to be moved, will provide for a broader range of exercise capability.

Furthermore, the number of weight plates 26 and, therefore, the amount of weight on each of the separate stack of weight plates 26*a*, 26*b* may be varied. Varying the amount of weight on each of the stacks will allow the individual or a prescribing physical therapist to exercise the muscle groups of each arm differently. For example, the chest, arm and back muscles of one side of the body may be responding better to the exercises than the chest, arm and back muscles of other side of the body and the muscles responding better to the exercises may be capable of moving more weight than the other muscles. This will allow the muscles of both sides of the body to be worked out at the same time, but allow for different levels of training, thereby cutting down on the overall time devoted to the workout.

As stated above, motor 20 is connected to handles 38 by bar 56 through drive plate 44. When motor 20 is energized, a rotational motion is induced in drive plate 44 which in turn is translated to a lateral motion in handles 38 by arm 24 through bar 56. With the hands of an individual positioned on handles 38, the lateral motion induced in handles 38 by motor 20 will continuously pull on cables 28 attached to cuffs 34 at the wrists of the individual as described above and move weight plates 26 in a lateral motion about frame 12 from the lowest position just above base 32 to the highest position and back to the lowest position just above base 32 again. An individual using exercise apparatus 10 with assistance from motor 20 to move handles 38, merely needs to place their hands on handles 38 and the motor 20 will force handles 38 to move which results in working the particular muscles of the body under exercise, in this case the chest, back and arms.

Along with adjusting the amount of weight moved at weight plates 26, the positioning of the tactile feedback interface member, handles 38*a*, 38*b*, may also be adjusted as illustrated in FIGS. 8D and 12A-12C. In this particular embodiment of the present invention, handles 38*a*, 38*b* may be secured to drive plates 44*a*, 44*b* by bars 56*a*, 56*b*. Multiple holes 50*c*, 50*d*, 50*e*, 50*f* may be included on the surface of each of drive plates 44*a*, 44*b* to allow for the repositioning of handles 38*a*, 38*b* relative to the center of rotation of motor 20. Allowing for the repositioning of handles 38*a*, 38*b* relative to the center of rotation of motor 20 will enable the individual to vary the range of motion the hands will travel through thereby allowing the therapist or user to adapt the range of motion to the ability of the user to optimize the workout of the chest, back and arm muscles.

Furthermore, the position of handles 38*a*, 38*b* may be varied between drive plates 44*a* and 44*b*. For example, the positioning of handle 38*a* relative to handle 38*b* may be varied by adjusting the position of bar 56*a* at hole 50*c* on plate 44*a* and adjusting the position of bar 56*b* at hole 50*e* on plate 44*b*. The varying the position of handles 38*a*, 38*b* allow the individual or a prescribing physical therapist to exercise the muscle groups of the chest, back and arms differently. For example, the group of muscles in the chest, back and arm of one side of the body may be responding better to the exercises than the group of muscles in the chest, back and arm of the other side of the body and the group of muscles in the chest, back and arm of one side of the body responding better to the exercises may be capable of a larger range of motion than the group of muscles in the chest, back and arm of the other side of the body. This will allow the muscles of the chest, back and arms of both sides of the body to be worked out at the same time, but allow for different levels of training, thereby cutting down on the overall time devoted to the workout.

Along with adjusting the amount of weight moved at the weight plates, the position of seat 14 relative to handles 38 may be adjusted to position the individual for an optimal chest press exercise and development of the muscles of the chest. The height of seat 14 may be raised or lowered to ensure a proper fit for all the different sizes and shapes of individuals and to provide for optimal muscle development and rehabilitation. Still further, the speed of motor 20 may be increased or decreased which, in turn, will increase or decrease the speed of handles 38 during the exercise. Similar to weight adjustments, speed adjustments will enable a wider range of exercise capability. Programming motor 20, through the programmable computer of apparatus 10, to stop for a period of time at one or more locations will also increase exercise capability.

Figure 8A:
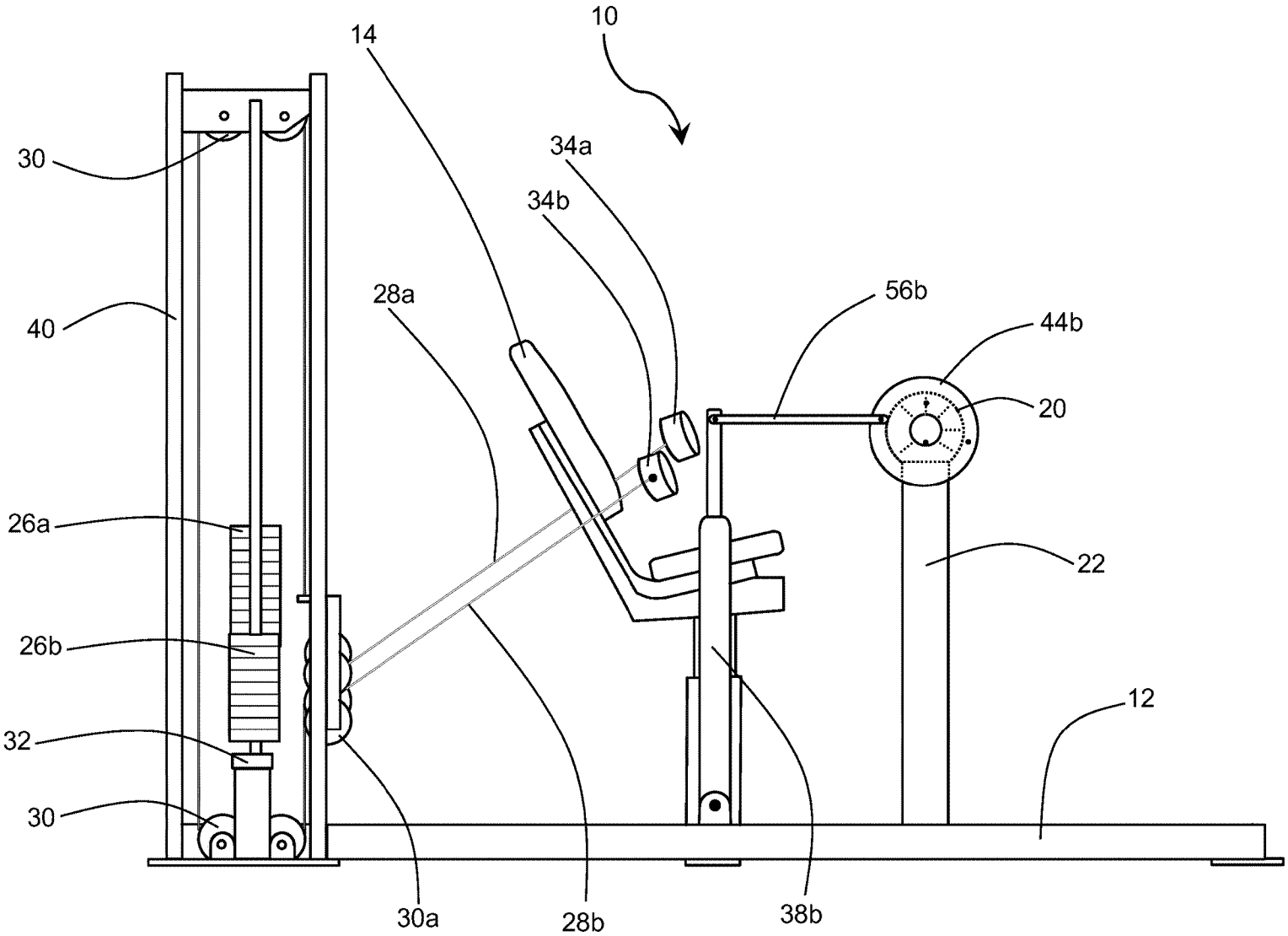
FIGS. 8A-8C are side views of an isometric, dynamic isotonic concentric and dynamic isotonic eccentric motorized guidance exercise apparatus according to still another embodiment of the present invention.
Figure 8B:
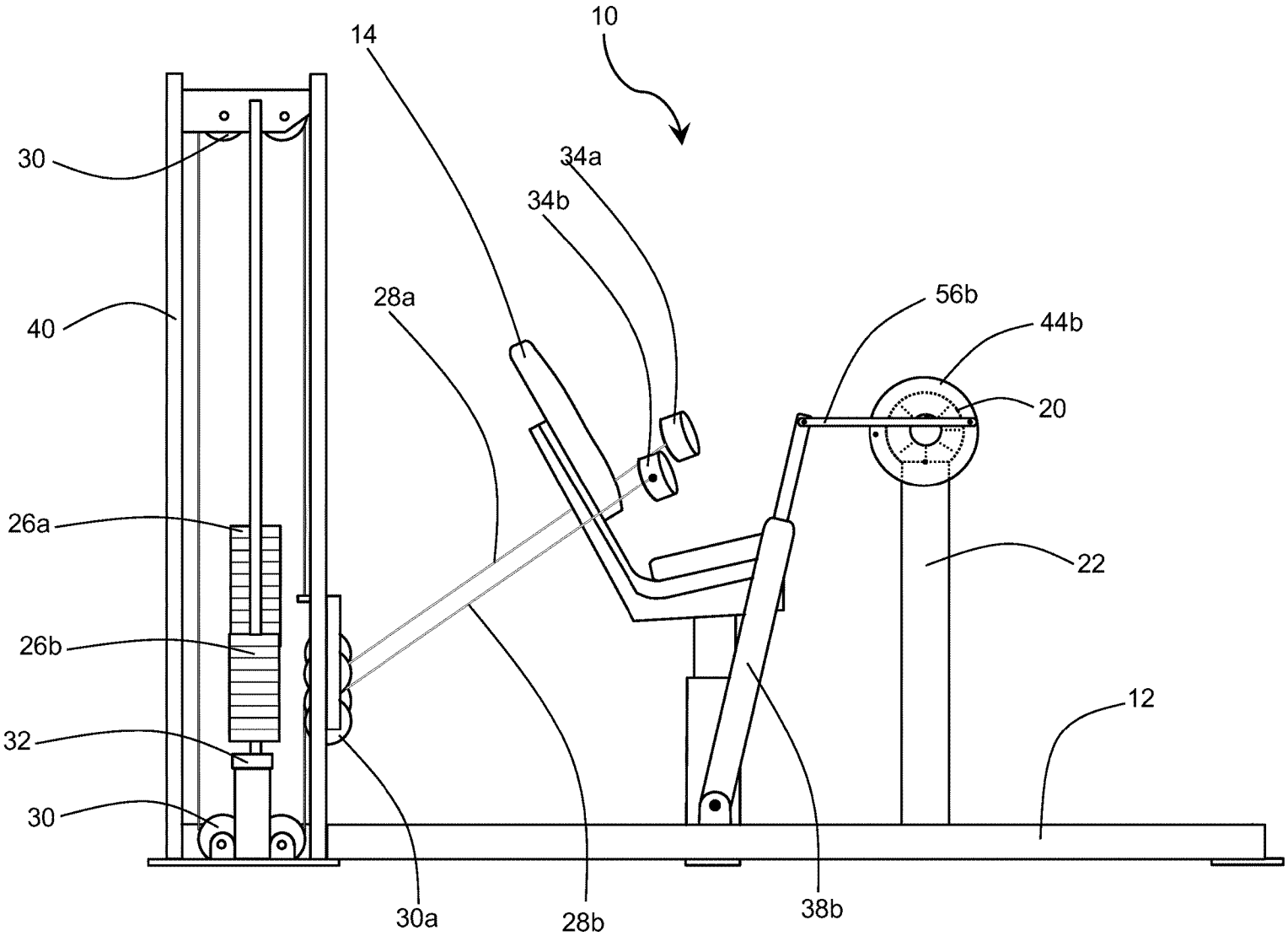
Figure 8C:
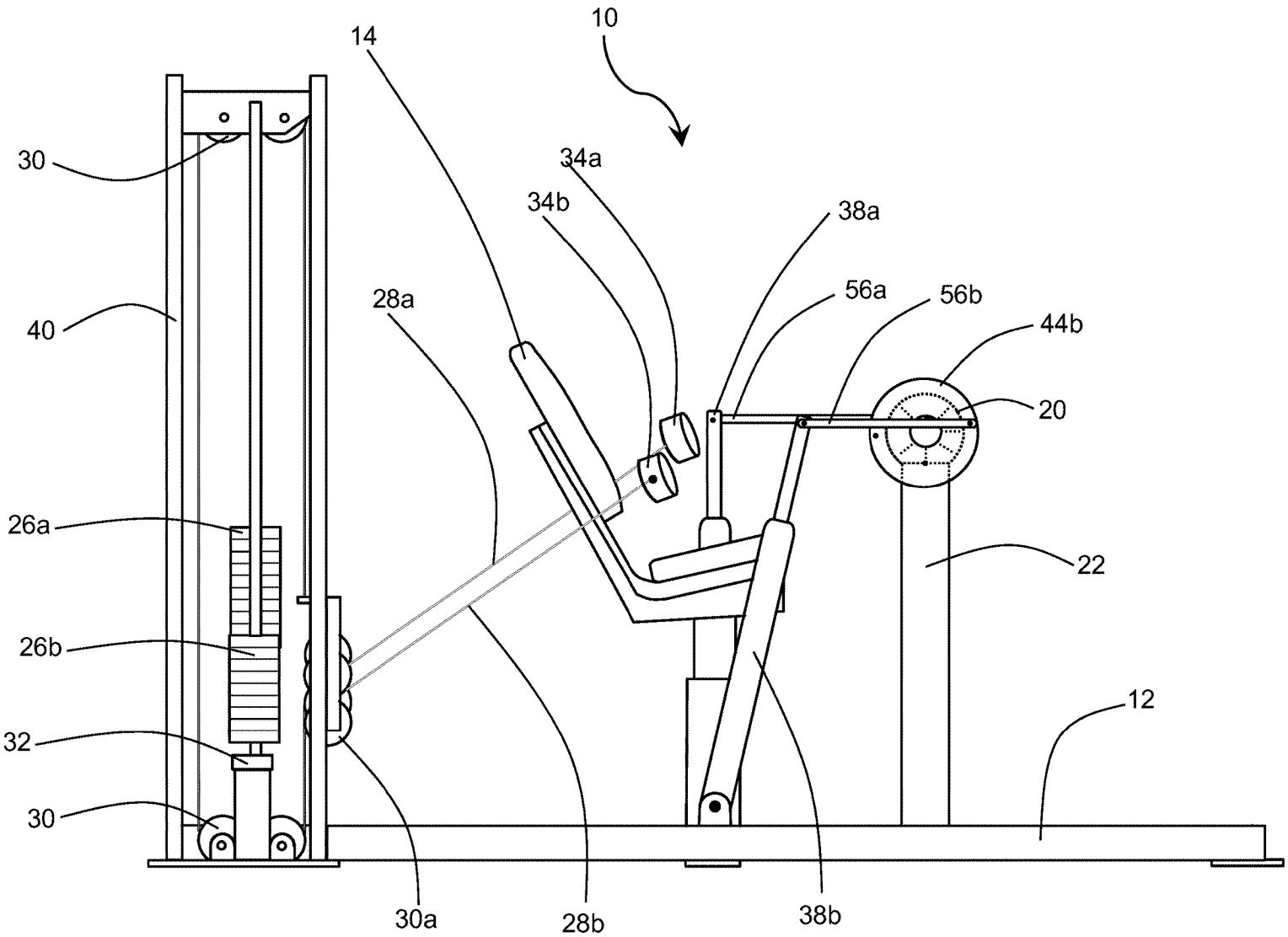
Figure 8D:
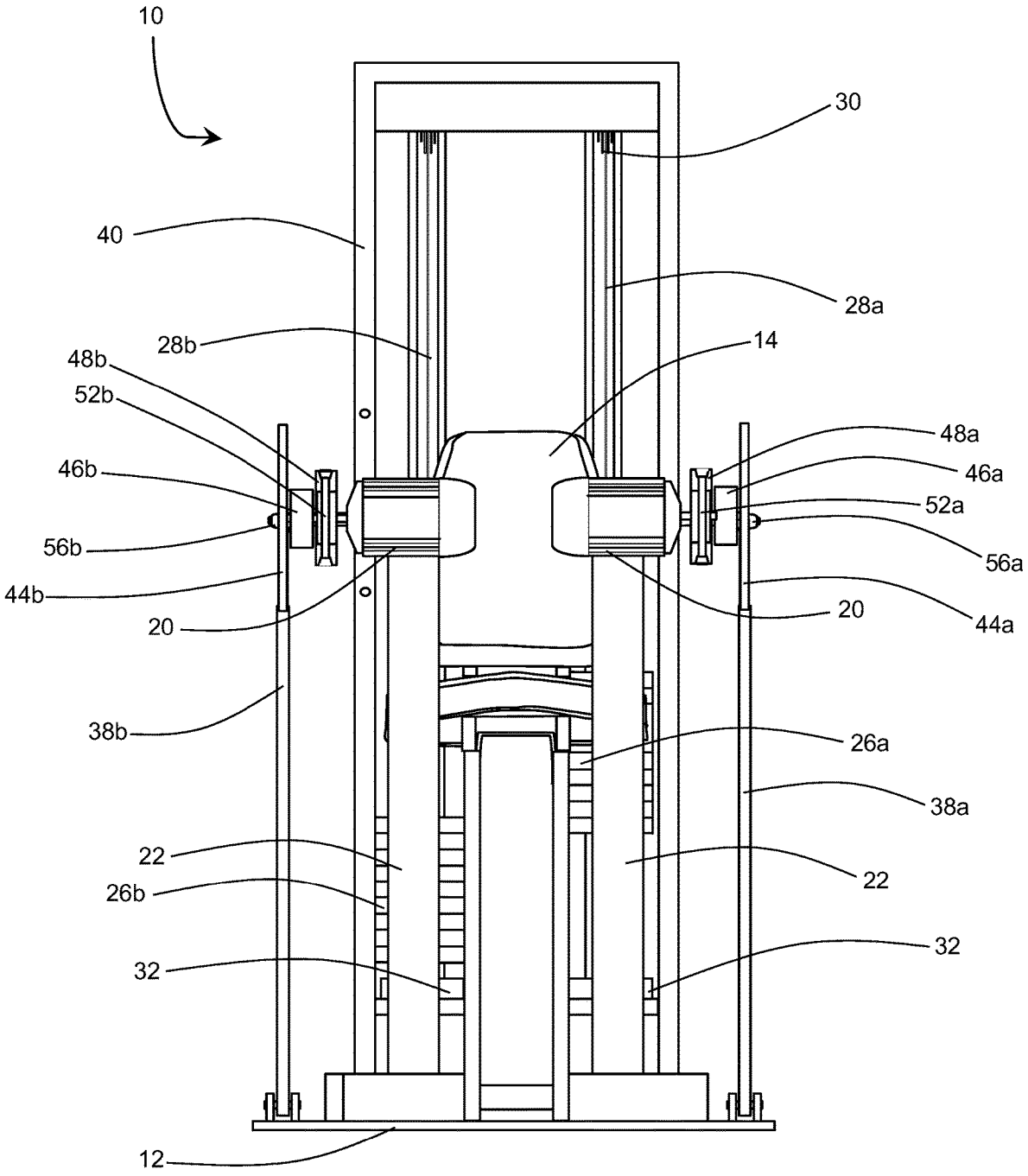
FIG. 8D is a front view of the motorized guidance exercise apparatus according to an embodiment of the present invention.
Figure 8E:
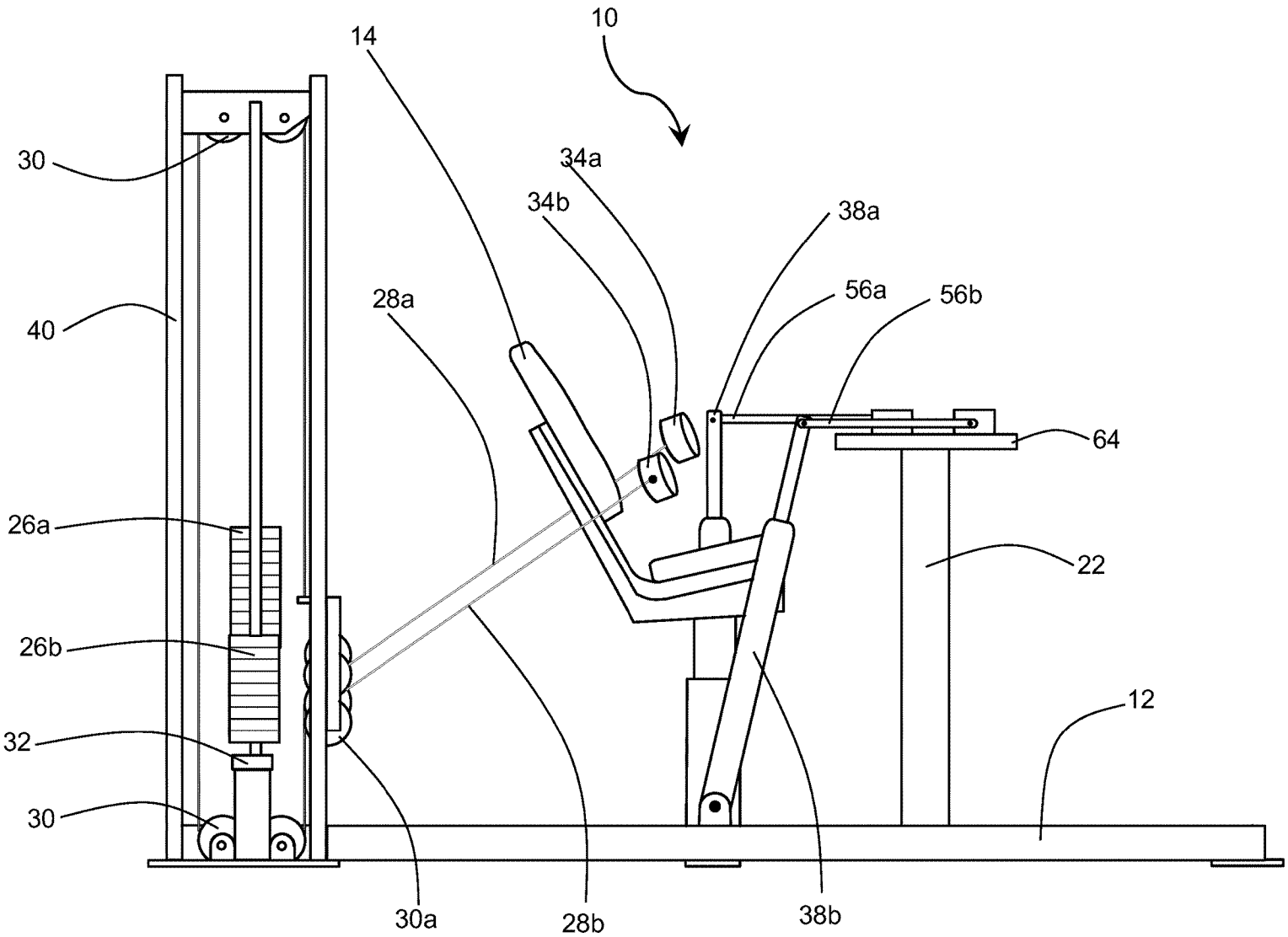
FIG. 8E is a side view of an isometric, dynamic isotonic concentric and dynamic isotonic eccentric motorized guidance exercise apparatus according to yet another embodiment of the present invention.
Figure 8F:
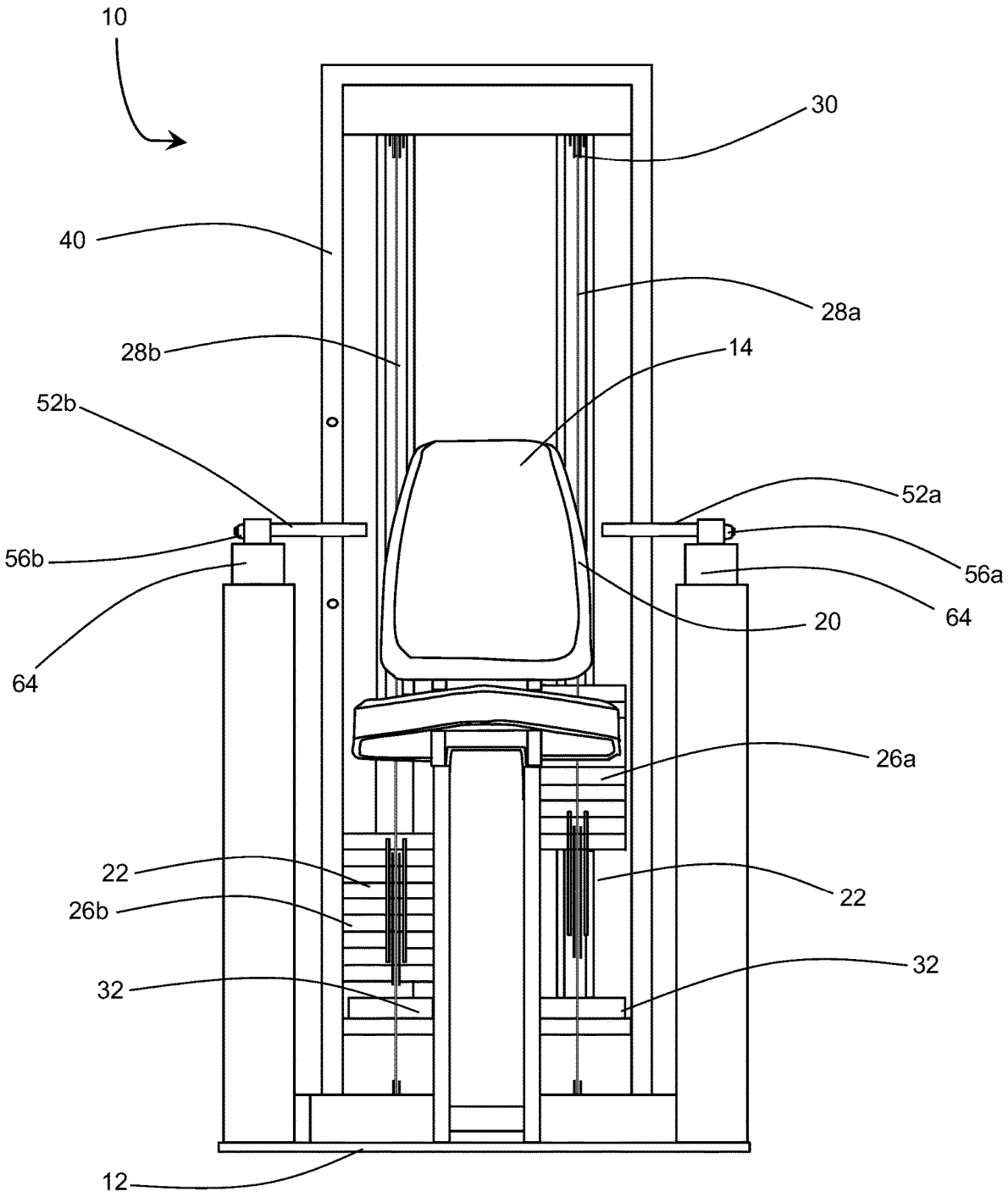
FIG. 8F is a front view of the motorized guidance exercise apparatus according to an embodiment of the present invention.

In still another embodiment of the present invention illustrated in FIGS. 8E and 8F, a linear or stepper motor 64 may replace motor 20 and drive plate 44 of exercise apparatus 10 illustrated in FIGS. 8A-8D. In this particular embodiment of the present invention, bar 56 may be connected directly to linear motor 64. Linear motor 64 is supported and secured to frame 12 at stanchion 22. All other operation of handles 38*a*, 38*b* and weight stacks 26*a*, 26*b* described above will work in the same manner with linear motor 64 but for the motion of motor 64. Rather than a rotation motion that is induced in motor 20, linear motor 64 will induce a motion in a single plane while providing additional programmable control to the therapist or individual user of exercise apparatus 10. Linear motor 64 may be programmed through the programmable computer of apparatus 10 to vary any of the following during a particular workout: the start points of handles 38 relative to the individual and the velocity in both direction along the length of linear motor 64. Linear motor 64 may also be programmed to stop at any position for a period of time along the path thereby stopping handles 38 at any position relative to the individual. Linear motor 64 will ensure a smooth controlled motion of handles 38 relative to the individual and provide the flexibility to stop the motion of handles 38 at any point. Apparatus 10 may also include a position sensor to provide feedback to motor 64 on location of motor 64 relative to handles 38.

In these two particular embodiments of the present invention, the hands of the individual using exercise apparatus 10 follow the path of the motor driven handles 38. The contact of the hands on the handles provides the body a tactile feedback that tells the body to follow the path of the handles as the weight attached at the wrists is moved by the individual. As motor 20 and linear motor 64 control the speed of the lateral movement of the handles 38, the hands of the individual will keep up with the speed set by motor 20 and linear motor 64 and move the amount of weight set at weight plates 26. The intent is not to have the individual apply energy to move their arms to move handles 38, but to allow the tactile feedback provided by the hands against handles 38 to move the hands along the lateral path of handles 38 and resist the load provided by weight plates 26. The load provided by weight plates 26 at the wrists forces the body to expend energy as the hands follow the lateral path of handles 38.

The working muscles in the instant embodiment, the muscles of the chest, muscles of the arms and muscles of the back are under a continuous load created by the attachment of the weights at the wrists as the arms move with handles 38. This result is both a dynamic isotonic concentric and dynamic isotonic eccentric motor guided exercise apparatus. Isotonic concentric movements occur when the working muscles shorten. Isotonic eccentric movements occur when the working muscles lengthen. A further benefit to the individual may be through isometric exercise. Isometric exercise is enabled when the motion of motor 20 is halted for a period of time while the resistance force is maintained by the working muscles. In these particular embodiments of the present invention, motor 20 and linear motor 64 are used to guide the hands through a fixed path at a fixed speed. As stated above, both the speed of motor 20 and linear motor 64 and the path of handles 38 may be adjusted to optimize muscle development. Tactile feedback ensures the hands stay in constant contact with handles 38 while handles 38 are moved laterally by motor 20 and linear motor 64 through bar 56. In contrast, other forms of exercise, such as walking and running for example, only work the muscles under isotonic concentric movements, when the muscles are shortening. Other forms of exercise, biking and climbing stairs for example, only work muscles under isotonic eccentric movements, when the muscles are lengthening. The present invention provides for both dynamic isotonic concentric and dynamic isotonic eccentric muscle movements and isometric holds during the same exercise. For an equal number of exercise cycles to the tradition exercises listed above, the present invention will enable the individual to expend twice the energy and achieve twice the effective workout compared to biking, stair climbing, walking, running and like exercises.

Furthermore, the hands, being in light tactile contact with handles 38, enables the hands to continually, repeatably and in a controlled manner follow the travel path. The travel distance per cycle and the travel speed at every point of the total travel path may also be controlled in a continual and repeatable manner while exercising the working muscle. The constant rotational speed of motor 20 and linear velocity of linear motor 64, bar 56 and handles 38 may limit the acceleration of weight plates 26 being lifted and the deceleration of weight plates 26 being lowered. Any additional load caused by the acceleration and deceleration of weight plates 26 may be minimized.

The force to lift the weight from the stack is equal to the weight of stacked weight plates 26 plus the acceleration of the mass of stacked weight plates 26. The muscles in the chest and the muscles in the arms work against this force. Because the rotational speed of motor 20 and the linear motion of linear motor 64 may be constant, the acceleration of weight plates 26 is controlled and may be minimized, which reduces the force of the acceleration on the muscles, tendons, ligaments and bones. In contrast, other forms of lifting stacked weight plates, such as a bench or shoulder press, arm curl and the like, do not control the speed or acceleration the individual exerts to move the weight plates. This may result in an increase in the force to initially move the weights and this uncontrolled movement and increased force on the particular body part that may lead to injury.

The force to lower the weight to a resting position from the stack is equal to the weight of stacked weight plates 26 plus the deceleration of the mass of the falling stacked weight plates 26. The muscles in the chest and the muscles in the arms work against this force. Because the rotational speed of motor 20 and the linear motion of linear motor 64 may be constant, the deceleration of weight plates 26 is controlled and may be minimized, which reduces the force of the deceleration on the muscles, tendons, ligaments and bones. In contrast, other forms of lifting stacked weight plates, such as a bench or shoulder press, arm curl and the like do not control the speed or deceleration the individual exerts to lower the weight plates. This may result in an increase in the force to lower the weights and this uncontrolled movement and increased force on the particular body part that may lead to injury.

As described above, a fixed force, such as weight plates 26 may be used as a means to increase and decrease the load an individual will work against to increase muscle tone. A variable force, such as springs or bands or a combination of a fixed force or variable force may be used in with motorized exercise apparatus 10 achieve the goal of working the muscles to a point of fatigue thereby facilitating faster muscle development, shortening muscle rehabilitation and decreasing the overall recovery period.

Figure 9A:
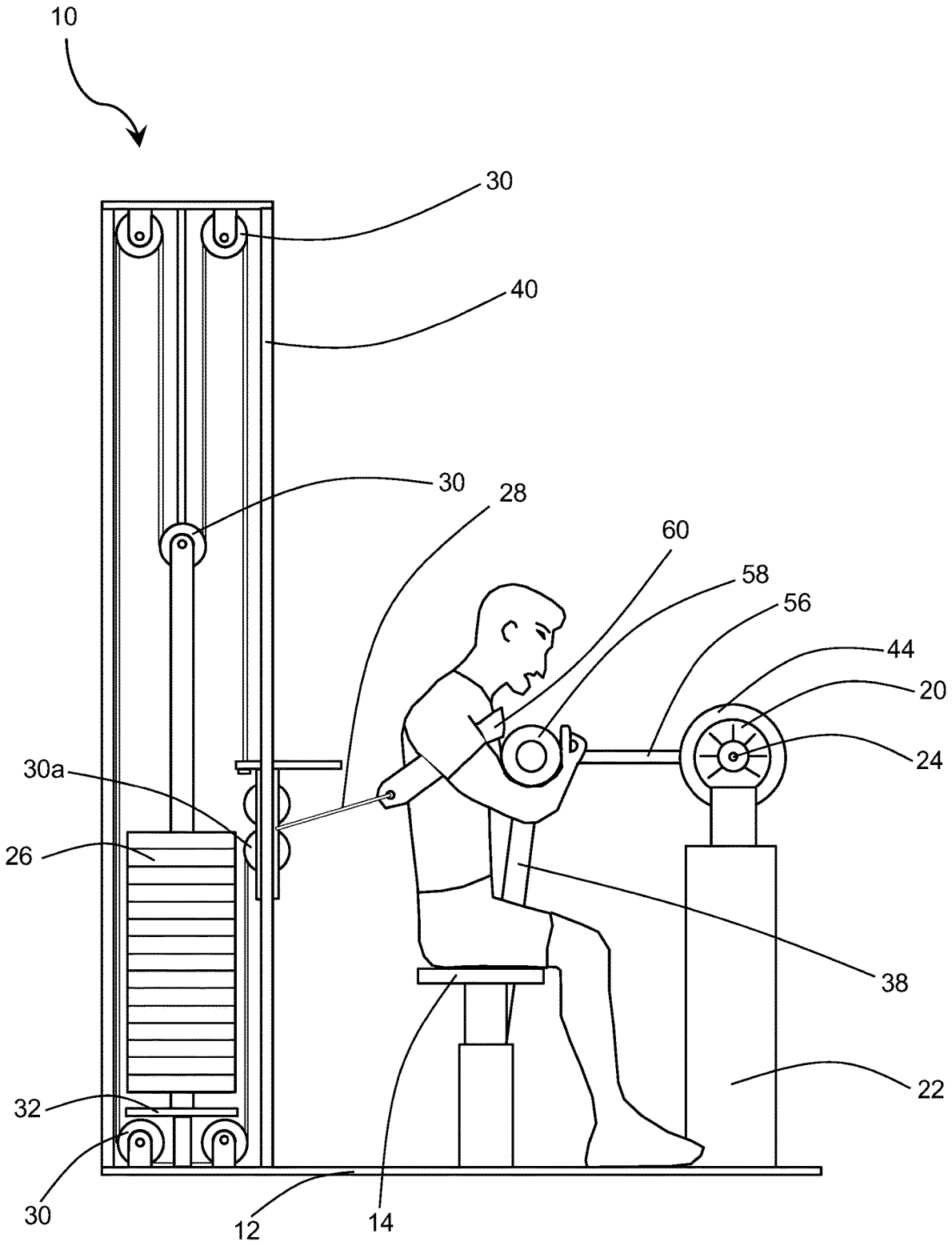
FIGS. 9A and 9B are side views of an isometric, dynamic isotonic concentric and dynamic isotonic eccentric motorized guidance exercise apparatus according to still another embodiment of the present invention.
Figure 9B:
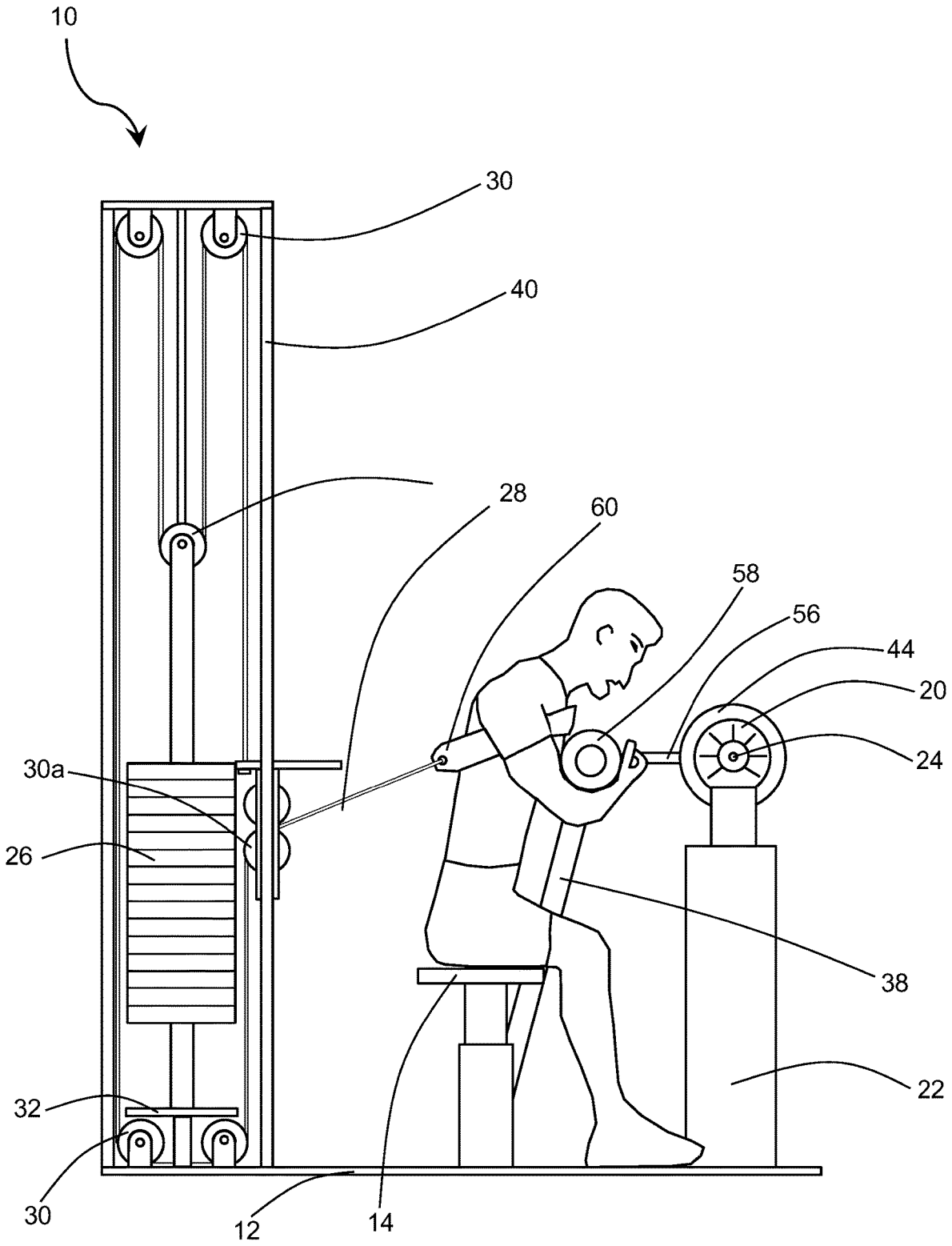
Figure 9C:
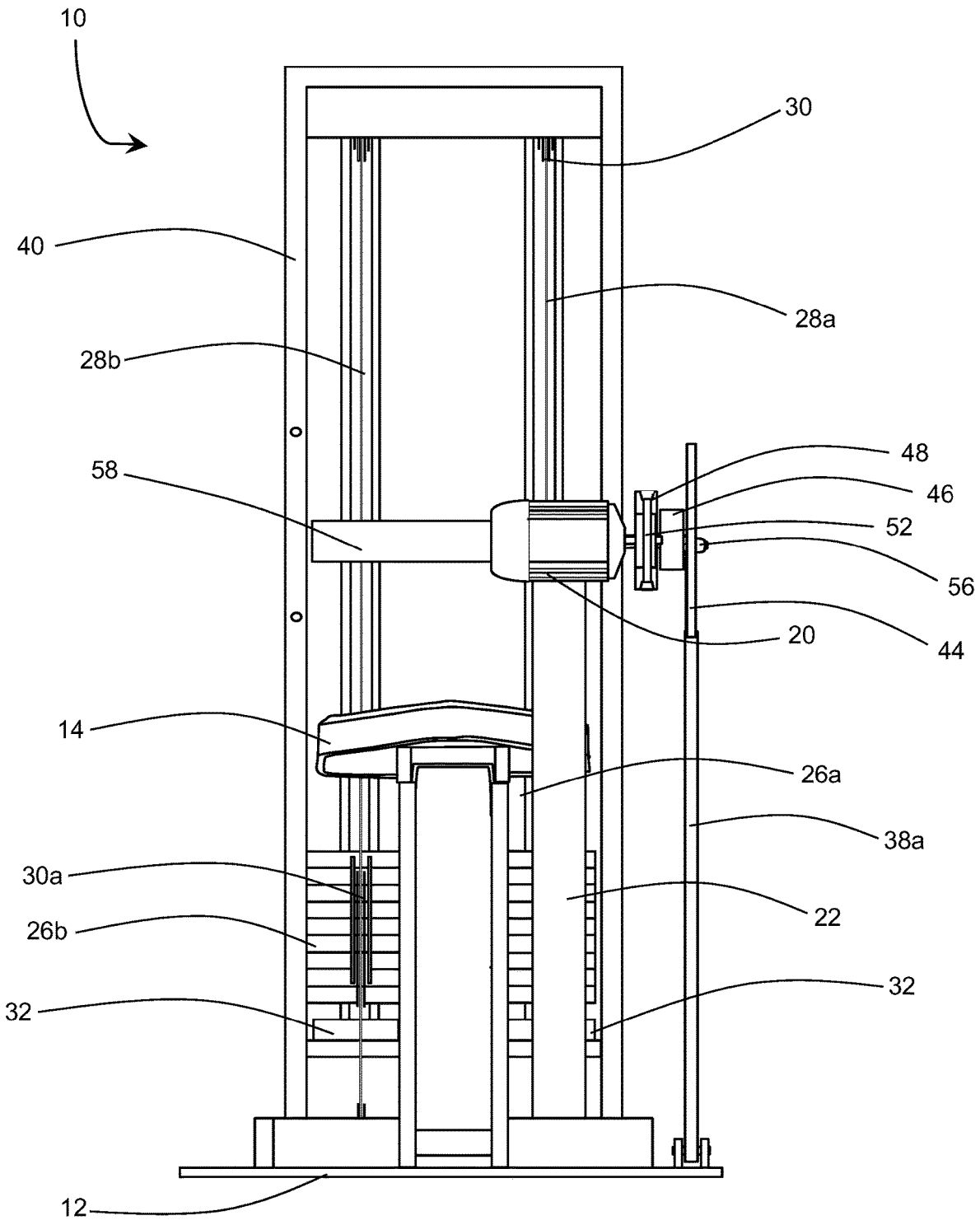
FIG. 9C is a front view of the motorized guidance exercise apparatus according to an embodiment of the present invention.

In yet another embodiment of the present invention, exercise apparatus 10 may be adapted to a traditional weight machine 40 and used to improve the muscles in the abdomen. FIGS. 9A-9C illustrate motorized exercise apparatus 10 adapted to exercise the muscles of the abdomen. As above, motor 20 is supported and secured to frame 12 at stanchion 22. In this particular embodiment of the present invention, motor 20 is further secured to a tactile feedback interface member. The tactile feedback interface member of this particular embodiment of the present invention is a roll bar 58 of weight machine 40. Roll bar 58 is secured to motor 20 by bar 56. Handle 38 secures roll bar 58 to weight machine 40. Motor 20 may be any type of motor including but not limited to a typical induction motor, a direct drive motor, a linear motor, a servo motor, a stepper motor and the like that may be connected to a power supply such that when motor 20 is energized, a drive plate 44 of motor 20 is rotated by motor 20. Drive plate 44 may be connected to roll bar 58 by bar 56 such that the rotating force of drive plate 44 induces a rotating motion in roll bar 58 and forces roll bar 58 into a lateral motion relative to weight machine 40 without any human interaction at handle 38. Apparatus 10 may also include a position sensor to provide feedback to motor 20 on location of motor 20 relative to handles 38.

In this particular embodiment of the present invention, a stack of weight plates 26 is present as a means of providing a resistance for the individual while the chest follows roll bar 58 as it moves away from weight plates 26. In this instance, a cable 28 may be used to secure a cuff 60, secured around the chest of an individual performing the exercise, to weight plates 26. Pulleys 30 may be added to apparatus 10 to guide cables 28 from cuff 60 to weight plates 26 as described above. An adjustable pulley **30*a* may also be included in apparatus 10 to allow pulleys 30*a* and cable 28 to be easily adjusted by the individual to modify the exercise motion for optimize muscle development. Pulleys 30 enable cable 28 to glide smoothly as cuff 60 attached at the chest of individual is moved away from weight plates 26 and toward the weight plates 24 as motor 20 drives roll bar 58**.

As motor 20 moves roll bar 58 relative to motorized exercise apparatus 10, cables 28 are always in tension and applying a load to the chest through cuff 60. As roll bar 58 is moved to the furthest distance away from weight plates 26, cables 28 will pull weight plates 26 upward from the lowest position near base 32. As roll bar 58 is moved to the nearest distance to weight plates 26, cables 28 will lower weight plates 26 to the lowest position just above base 32. As the chest of the individual follows the fore and aft motion of roll bar 58, weight plates 26 will move from its lowest position just above base 32 to an upward position and back to its lowest position just above base 32. An individual will realize all the benefits for the muscles of the abdomen as were described above for the muscles of the chest, back and arms.

Figure 9D:
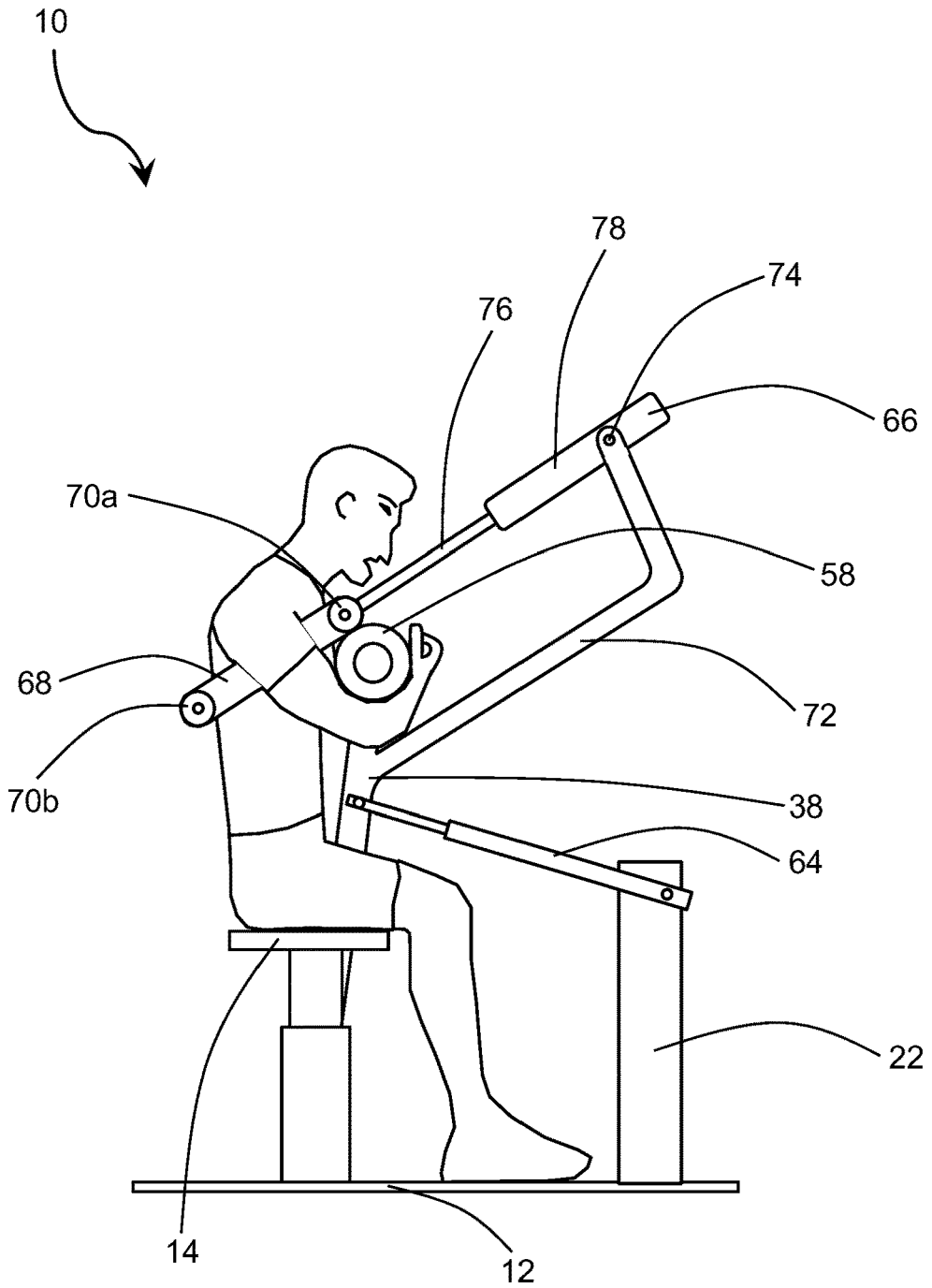
FIGS. 9D and 9E are side views of an isometric, dynamic isotonic concentric and dynamic isotonic eccentric motorized guidance exercise apparatus according to yet another embodiment of the present invention.
Figure 9E:
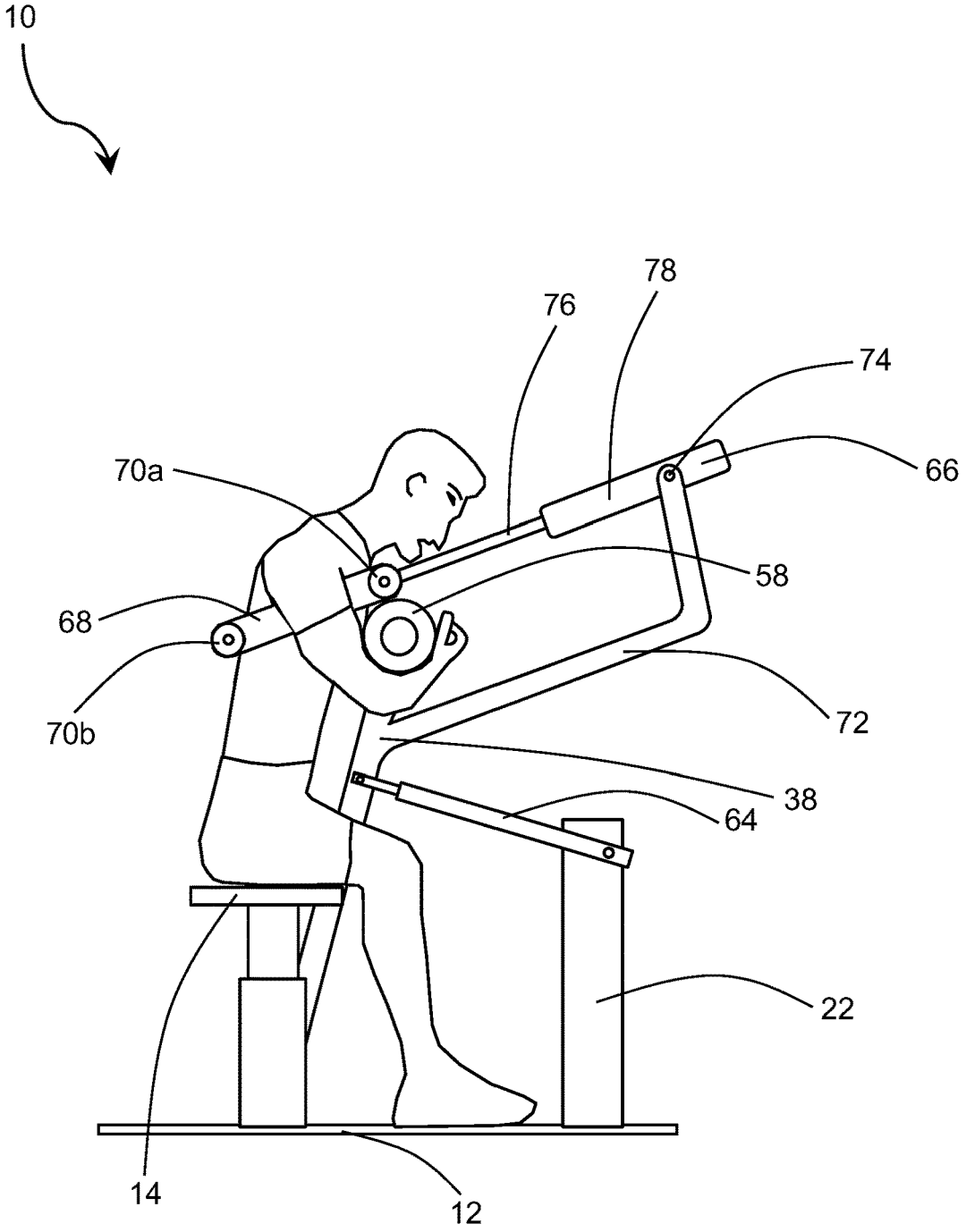

In still another embodiment of the present invention illustrated in FIGS. 9D and 9E, linear motor 64 may be added to weight machine 40 and may replace motor 20 in exercise apparatus 10 illustrated in FIGS. 9A-9C and a piston 66 may be used as a resistance force device and replace weight stacks 26 and cables 28. Linear motor 64 is supported and secured to frame 12 at stanchion 22. Piston 60 includes a rod 76 and a cylinder 78. In this particular embodiment of the present invention, linear motor 64 is further secured to handle 38. Rod 76 of piston 66 is secured to a chest cuff 68. Chest cuff 68 includes a front cushion **70*a* that contacts the chest of an individual and a rear cushion 70*b* that contact the back of an individual. Chest cuff 68 will replace cuff 60 in this particular embodiment of the present invention. The tactile feedback interface member is roll bar 58 of weight machine 40. Roll bar 58 may be secured to linear motor 20 through handle 38. Handle 38 secures roll bar 58 to weight machine 40. An arm 72 secures handle 38 to cylinder 78 of piston 60 at pin 74. Pin 74 allows piston 60 to rotate relative to arm 72 and handle 38**.

Rather than a rotation motion that is induced in motor 20, linear motor 64 will induce a motion in a single plane while providing additional programmable control to the therapist or individual user of exercise apparatus 10. Linear motor 64 may be programmed to vary any of the following during a particular workout: the start point of roll bar 58 relative to the individual and the velocity in both direction along the length of linear motor 64. Linear motor 64 may also be programmed to stop at any position along the path thereby stopping roll bar 58 at any position relative to the individual. Linear motor 64 will ensure a smooth controlled motion of roll bar 58 relative to the individual and provide the flexibility to stop the motion of roll bar 58 for a period of time at any point. When linear motor 64 is energized, linear motor 64 will induces a linear motion in handle 38 and roll bar 58 and force roll bar 58 into a lateral motion relative to weight machine 40 without any human interaction at handles 38. Programing the motion of linear motor 64, through the programmable computer of apparatus 10, to stop at a particular location for a period of time while the resistance force is maintained by the working muscles produces the isometric exercise.

As stated above, piston 60 is present as a means of providing a resistance force for the individual while the chest follows roll bar 58 as it moves toward piston 60. In this instance, piston 60 provides a resistive force either through a pneumatic compression of air or a hydraulic compress of liquid as rod 76 enters and exits cylinder 78. Piston 60 will provide a resistive force for the body of the individual as the individual travels forward toward piston 60. The individual applies a force at chest cuff 68 through contract of the abdominal muscles that drives rod 76 into cylinder 78. The resistance within piston 60 is created by the force of rod 76 against the air or liquid within cylinder 78. Piston 60 will also provide a resistive force for the body of the individual as the individual travels away from piston 60. The individual applies a force at chest cuff 68 through contraction of the back muscles that pulls rod 76 out of cylinder 78. The resistance within piston 60 is created by the force of rod 76 against the air or liquid within cylinder 78. As the chest of the individual follows the fore and aft motion of roll bar 58, rod 76 will enter and exit cylinder 78 of piston 60. An individual will realize all the benefits for the muscles of the abdomen and back as were described above for the muscles of the chest, back and arms. Further, the operation of piston 60 in this manner provides a very smooth transfer of force from the body over the resistance provided by piston 60 and further alleviates concerns with the forces caused by the sudden acceleration and sudden deceleration of stack weights as described above.

As described above, piston 60 is linked to linear motor 64 through arm 72 and handle 38. Piston 60 is linked to the position and direction of movement of linear motor 64 and linear motor 64 can be programed to apply a force opposite the direction of motion of piston 60. The applied force can be programmed into linear motor 64 to be a different force for each location of liner motor 64 and each position of linear motor 64. Further, piston 60 could be programed to apply a force at chest cuff 68 and could be a force that remains constant or vary while linear motor 64 is in a stopped position. With linear motor 64 in a stopped position, and a force being applied at piston 60 against the body of the individual, the individual is realizing the benefits of an isometric exercise, a further benefit of exercise apparatus 10. As described above, exercise apparatus 10 enables the benefits of isotonic concentric movements, when the working muscles shorten, and isotonic eccentric movements, when the working muscles lengthen. Exercise apparatus 10 also enables the benefits of isometric exercise when linear motor 64 is in a stopped position and the exercises are static or the muscles are holding a position against a resistance force, in this case against the resistance force of piston 60, and there is no joint movement. Further, the resistance force may be programmed by the programmable computer to vary based on the location and direction of motion desired to maximize muscle development.

Figure 13:
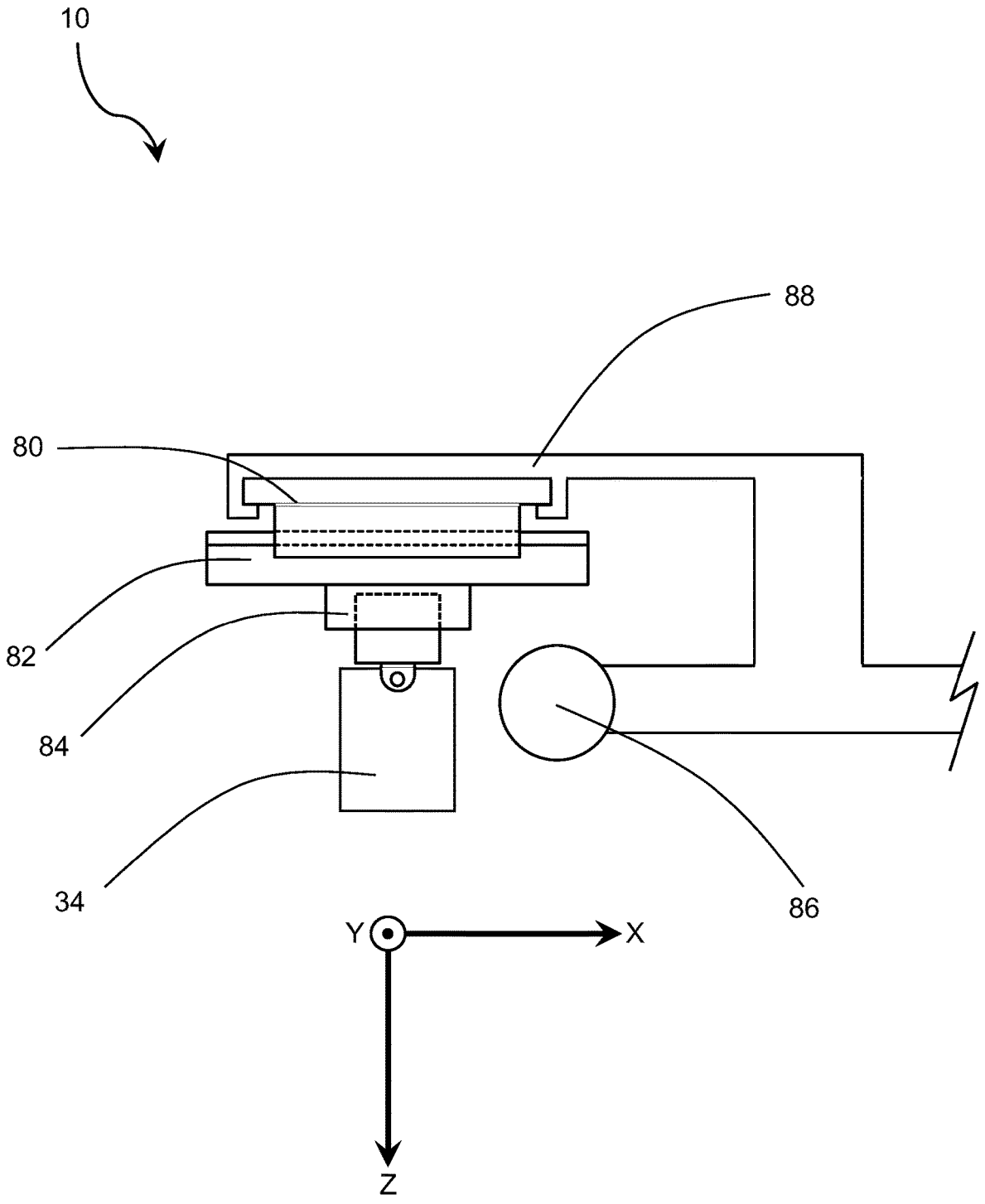
FIG. 13 is a top view of a linkage system and motor of the motorized guidance exercise apparatus according to still another embodiment of the present invention.
Figure 14:
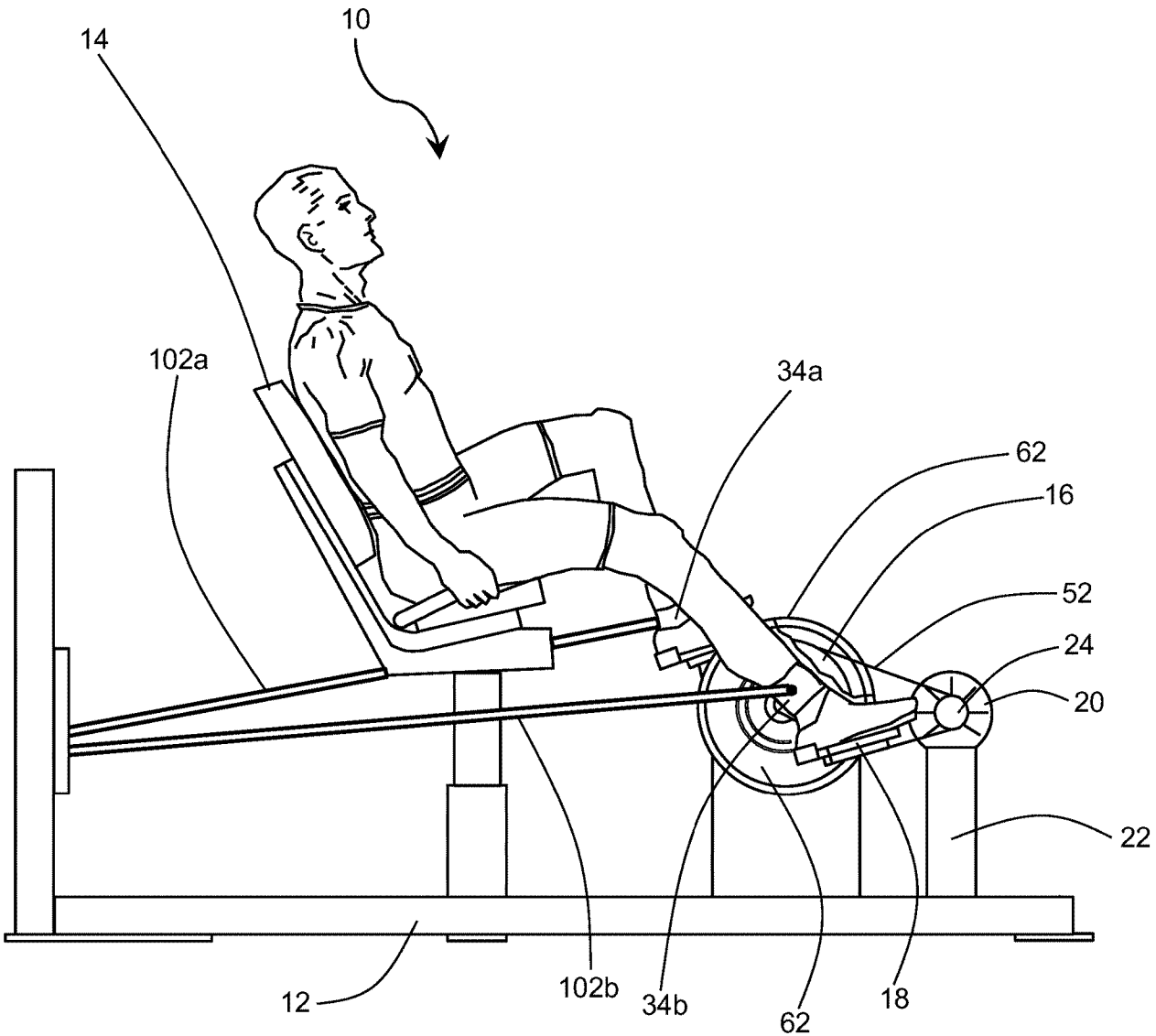
FIG. 14 is a side view of the motorized guidance exercise apparatus according to yet another embodiment of the present invention.

In yet another embodiment of the present invention, exercise apparatus 10 may be adapted to include a plurality of linear motors. In this particular embodiment of the present invention illustrated in FIG. 13, linear motors 80, 82 and 84 are included in exercise apparatus 10. Linear motors 80, 82 and 84 may be secured to an arm 88 of a multi-axis programmable robot arm or similar programmable computer device. Apparatus 10 further includes cuff 34 that may be secured to the human body at a wrist or ankle for example and a ball 86 that is the tactile feedback interface member.

In this particular embodiment of the present invention, an individual may place their wrist in cuff 34 such that their hand may be in contact with ball 86. The robot or similar programmable device may move ball into a variety of positions in all three directions and the hand and wrist will follow the position of ball 86 by using the muscles of the arm to ensure the wrist and hand follow ball 86. In this instance, linear motors 80, 82 and 84 are the resistance force device that provide the resistance against the arm muscles that the muscles must overcome to ensure the hand maintains contact with ball 86. The linear motors will simulate the resistance of the weight stacks, springs, bands and piston. Linear motor 80 produces a resistance force in a "Y" direction relative to arm 88. Linear motor 82 produces a resistance force in a "X" direction relative to arm 88. Linear motor 84 produces a resistance force in a "Z" direction relative to arm 88. Together, the three linear motors 80, 82 and 84 produces a resistance force against the arm muscles and hand in all three directions.

The resistance offered by linear motors 80, 82 and 84 against the resistance force applied by the muscles of the arms may be adjusted to either increase or decrease that resistance force. As stated above, the resistance force of each of the linear motors is programmable by a therapist or individual user. The resultant resistance vector force of linear motors 80, 82 and 84 may be programmed through the programmable computer of apparatus 10 to be in-line with the vector direction of motion of ball 86. The resultant vector force can may be programmed to be different for every position of ball 86. The resultant vector force value can also be programmed to change based on the direction of moving ball 86. Ball 86 can also be programmed to stop for a period of time at any location with the desired resultant vector resistance force applied. This will result in a three-dimensional isometric, dynamic isotonic concentric and dynamic isotonic eccentric exercise.

It is important to note that the liner motor or stepper motor detailed above may be used in any of the embodiments disclosed above to enable the location, velocity and direction of motion to be linked to the program that controls the force exerted by the resistance force device and the direction of that force. Further, a position sensor may be used with any linear motor or stepper motor detailed above to provide feedback to the motor on location of the motor relative to any tactile feedback interface member.

It is also important to note that motorized exercise apparatus 10 may also be adapted to any exercise weight machine as well to assist users with lifting weights to a point of fatigue to speed muscle development and/or rehabilitation. For example, apparatus 10 may be used with any weight machine that works muscles in the back and legs as well. Motor 20 or linear motor 64 may be connected to any tactile feedback interface member such as an armature of the weight machine to induce a movement in the weight machine. As described above, cuffs may be configured to be secured at the hands or wrists, the ankles, the chest as well as the upper leg such that the particular body part may be connected to the weight plates or other form of resistance. For example, motor 20 or linear motor 64 may be attached to a tactile feedback interface member such as a foot plate of a leg press such that the foot plate of the leg press may be put into a constant motion when the motor is actuated. Cuffs may be attached to the ankles of an individual on one end and a resistance means such as a plate or plates of a weight stack, a spring, a piston or other resistance means on the other end. The feet of the individual will be in tactile contact with the foot plate of the leg press and the motor will guide the individual through the leg press workout as described above in further detail to improve overall muscle development.

The present invention has been particularly shown and described with reference to the foregoing embodiments, which are merely illustrative of the best modes presently known for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiments are illustrative, and no single feature or element is essential to all possible combinations that may be claimed in this or a later application.

What is claimed is:

1. An isometric, dynamic isotonic concentric and dynamic isotonic eccentric motorized guidance exercise apparatus for human muscle development comprising:

a frame;

an electric motor; said electric motor including an output shaft and said electric motor secured to said frame;

a drive guidance assembly, said drive guidance assembly secured to said frame and connected to said output shaft of said electric motor;

at least one tactile feedback interface member, said at least one tactile feedback interface member secured to said drive guidance assembly;

a resistance force device, said resistance force device configured to be secured to a limb of the human body the limb positioned proximate said at least one tactile feedback interface member; and wherein energizing said electric motor actuates said drive guidance assembly, said drive guidance assembly induces a motion in said at least one tactile feedback interface member, wherein said at least one tactile Feedback interface member is configured to be engaged by the limb and said resistance force device is configured to be actuated by the limb.

2. The exercise apparatus as recited in claim 1, wherein said drive guidance assembly includes:

a second flywheel;

at least one drive plate; and at least one bearing.

3. The exercise apparatus as recited in claim 2, wherein said at least one tactile feedback interface member is at least one first handle, said at least one first handle secured to said at least one first drive plate by a first bar, said at least one first drive plate including multiple holes to modify the position of said first bar and said at least one first handle relative to said at least one first drive plate.

4. The exercise apparatus as recited in claim 3, wherein said at least one tactile feedback interface member is a second handle and a second drive plate, said second handle secured to said second drive plate by a second bar, said second drive plate including multiple holes to modify the position of said second bar and said second handle relative to said second drive plate, the position of said second handle capable of being positioned independently of said first handle.

5. The exercise apparatus as recited in claim 2, wherein said at least one tactile feedback interface member is at least one first pedal, said at least one first pedal secured to said at least one first drive plate, said at least one first drive plate including multiple holes to modify the position of said at least one first pedal relative to said at least one first drive plate.

6. The exercise apparatus as recited in claim 5, wherein said at least one tactile feedback interface member is a second pedal, said second pedal secured to said second drive plate, said second drive plate including multiple holes to modify the position of said second pedal relative to said first second drive plate, the position of said second pedal capable of being positioned independently of said first pedal.

7. The exercise apparatus as recited in claim 2, wherein said at least one tactile feedback interface member is a foot plate.

8. The exercise apparatus as recited in claim 1, wherein said drive guidance assembly includes a cover and a first flywheel.

9. The exercise apparatus as recited in claim 8, wherein said at least one tactile feedback interface member comprises at least one first pedal, said at least one first pedal secured to said first flywheel by a first arm, said first arm including multiple holes to modify a position of said at least one first pedal relative to said first flywheel.

10. The exercise apparatus as recited in claim 9, wherein said at least one tactile feedback interface member comprises a second pedal, said second pedal secured to said first flywheel by a second arm, said second arm including multiple holes to modify a position of said second pedal relative to said first flywheel the position of said second pedal capable of being positioned independently of said first pedal.

11. The exercise apparatus as recited in claim 1, wherein said exercise apparatus includes a programmable computer, said programmable computer capable of storing a number of read/write access programs to control an operation of said electric motor.

12. The exercise apparatus as recited in claim 11, wherein said electric motor is a linear motor, a position, velocity, location, duration of time of motor stops and direction of motion of said linear motor are determined by said programmable computer.

13. The exercise apparatus as recited in claim 11, wherein said electric motor is a stepper motor, said stepper motor including a position sensor, a position, velocity, location, duration of time of motor stops and direction of motion of said stepper motor are determined by said programmable computer.

14. The exercise apparatus as recited in claim 1, wherein said resistance force device is at least one weight plate of a weight stack, said at least one weight plate configured to be connected to a cable by a cuff, the cuff configured to be placed around the limb of the human body.

15. The exercise apparatus as recited in claim 1, wherein said resistance force device is at least one spring, said at least one spring configured to be connected to a cuff, the cuff configured to be placed around the limb of the human body.

16. The exercise apparatus as recited in claim 1, wherein said resistance force device is at least one band, said at least one band configured to be connected to a cuff, the cuff configured to be placed around the limb of the human body.

* * * * *